US006910995B2

(12) United States Patent
Schneider et al.

(10) Patent No.: US 6,910,995 B2
(45) Date of Patent: Jun. 28, 2005

(54) EASY OPEN FEATURE FOR RECLOSABLE BAGS HAVING A LONGITUDINAL FIN SEAL

(75) Inventors: John H. Schneider, Frankfort, IL (US); Nigel Knight, Kankakee, IL (US); Stanley Piotrowski, Addison, IL (US); Patricia I. Norek, Manteno, IL (US); Jeffrey Griffin, Atlanta, GA (US); David J. Matthews, Gilman, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/213,616

(22) Filed: Aug. 7, 2002

(65) Prior Publication Data

US 2004/0029694 A1 Feb. 12, 2004

(51) Int. Cl.[7] ..... B31B 1/90

(52) U.S. Cl. ..... 493/394; 493/213; 493/229; 493/232; 493/237; 493/268; 53/133.4; 53/133.8; 53/412

(58) Field of Search ..... 53/412, 133.4, 53/133.8, 139.2; 493/199, 212, 213, 229, 232, 237, 268, 927, 394

(56) References Cited

U.S. PATENT DOCUMENTS

| | | | | | |
|---|---|---|---|---|---|
| 5,022,530 | A | * | 6/1991 | Zieke | 383/204 |
| 5,514,067 | A | * | 5/1996 | Schmidt et al. | 493/196 |
| 5,542,902 | A | * | 8/1996 | Richison et al. | 493/195 |
| 6,212,857 | B1 | * | 4/2001 | Van Erden | 53/412 |
| 6,224,262 | B1 | | 5/2001 | Hogan et al. | |
| 6,237,837 | B1 | * | 5/2001 | Martin | 229/71 |
| 6,318,894 | B1 | | 11/2001 | Derenthal | |

FOREIGN PATENT DOCUMENTS

EP 1 072 526 A2 1/2001

* cited by examiner

*Primary Examiner*—Rinaldi I. Rada
*Assistant Examiner*—Thanh Truong
(74) *Attorney, Agent, or Firm*—Pitney Hardin LLP

(57) ABSTRACT

A method of making a reclosable plastic bag (38) having a fin seal (35) which provides a weakness area (23, 80, 81, 84, 86) that extends into at least one side of the fin seal (35). Perforation axes (19, 20) for opening the reclosable plastic bag (38) may be aligned with the weakness area (23, 80, 81, 84, 86). A reclosable bag (38) made in accordance with the method is also disclosed.

11 Claims, 33 Drawing Sheets

EASY OPEN FEATURE FOR RECLOSABLE BAGS HAVING A LONGITUDINAL FIN SEAL

FIELD OF THE INVENTION

The present invention relates to reclosable plastic bags of the type in which perishable food products and other goods are packaged for sale to consumers in retail outlets. More specifically, the present invention relates to a method of producing plastic bags which are concurrently manufactured to include a fin seal, and the manner of producing such bags so that they may more readily be torn open through the fin seal.

DESCRIPTION OF THE PRIOR ART

The present invention relates to improvements in the package-making art and may be practiced in the manufacture of reclosable thermoplastic bags and packages of the type that may be used for various consumer products. Such packages often include a form of peel-seal to render the package moisture-tight and/or airtight prior to the initial opening, and/or a tamper-evident seal. A zipper means protects any remainder of the product therein after the initial opening.

The indicated art is fairly well developed but nevertheless remains open to improvements contributing to increased efficiency and cost-effectiveness. In the prior art, McMahon et al. (U.S. Pat. No. 4,909,017) discloses a method of making a form-fill and seal bag having a reclosable fastener. Prior to entering the form-fill and seal machine, fastener strips are attached to the surface of the film transverse to the running direction at bag length intervals. The fastener strips contain pre-joined interlocked rib and groove strips. Only one of the strips is attached to a top surface of the film with the other strip facing upwardly or, in other words, inwardly toward the interior of the bag to be formed. The attached strips are secured in one form at the center of the film and each strip is less than half of the film width. The film is then advanced to the form-fill and seal machine and is drawn down over a forming collar and about the filling tube, with the longitudinal side edge margins of the film brought together and seamed with a fin seal to form a tube. Cross-seals are made across the tube to join the unattached fastener strip to the film to form the closure and to form the bottom of the following bags. A further seal may be provided above the fastener to provide tamper-evident sealing. In such case, an easy-open feature such as a line of weakness in the form of a line of perforations or a score line would be provided for the bag between the top seal and the fastener strip.

A potential problem with the above method is that the bag walls contain layers which will be doubled or tripled in the area of the fin seal which must be tom through to open the bag. While the line of weakness aids in starting the tear through the bag walls, tearing through multiple layers of the fin seal and the underlying bag may be difficult for the consumer to achieve. A significant step would involve reducing the amount of layers of bag film in the fin seal or weakening the layers of bag film in the fin seal area. When opening the bag by tearing along provided perforations or a score line in the bag, the fin area would be a reduced impediment, thus providing the bag with an easy-open feature.

SUMMARY OF THE INVENTION

Accordingly, the present invention relates to a method for producing a reclosable plastic bag with an easy-open feature in which a length of bag making film is advanced in a bag forming direction. A length of fastener having first and second mateable profile strips is attached to a mid-portion of the bag making film transverse to the bag forming direction, while leaving sides of film on opposite ends of the length of fastener. A weakness area is created in at least one of the sides with the weakness area comprising either an aperture, multi-line perforations of the bag film, scoring of the bag film, or any other weakening method known to those skilled in the art. The weakness area aligns with a flange portion of one of the profile strips or with an area of film adjacent the flange portion.

In a later stage of manufacture, the weakness area extends into a side margin that runs to an edge of one of the sides. The side margin of one side, together with a side margin of an opposite side, is sealed in a fin seal to form a tube. The unattached length of fastener is sealed to the inner surface of the tube that includes the fin seal. When the fin seal is formed, and if the weakness area comprises an aperture aligning with the flange portion, a portion of the opposite side margin of the fin seal is sealed to the flange portion of the fastener through the aperture. If the weakness area comprises an aperture aligning with an area of film adjacent the flange portion, a portion of the opposite side margin of the fin seal is sealed to the bag making film of the front bag wall through the aperture. Alternatively, a weakness area other than an aperture can be created when the fin seal is formed, instead of at the stage of manufacturing described earlier. In the last stage of manufacturing, the tube is cross-sealed at spaced intervals to form a bag. An opening notch is provided to create a tear line that will run through the weakness area.

BRIEF DESCRIPTION OF THE DRAWINGS

Further objects and advantages of the invention will become apparent from the following description and claims taken in conjunction with the accompanying drawings, in which:

DETAILED DESCRIPTION OF THE PREFERRED EMBODIMENT

Figure 1:
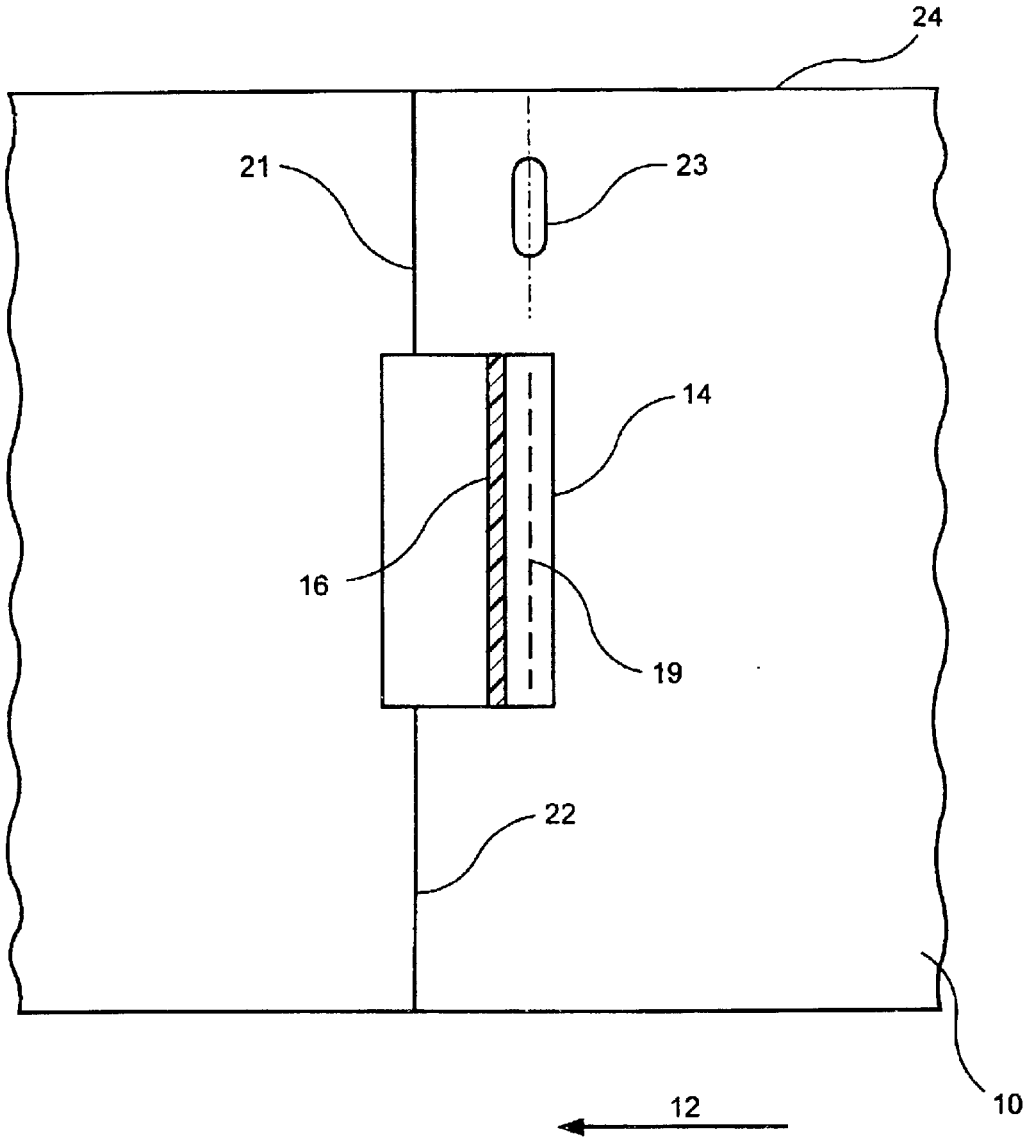
FIG. 1 is a plan view depicting a first embodiment of the present invention wherein a perforated fastener with an adjacent elliptical aperture is formed on a section of thermoplastic film.

Referring now to the drawings in detail wherein like numerals indicate like elements throughout the several views, a continuous length of thermoplastic packaging film 10 is shown in FIG. 1 prior to sealing, where the film would be fed to a form-fill and seal machine in movement direction 12.

In accordance with the present method, a fastener strip 14 with male and female profiles joined by their interlocking elements is attached to the midsection of the film 10 extending in a direction transverse to movement direction 12. Only profile 16 that sits on the thermoplastic film 10 is attached to the film. The other profile 18, as depicted in FIG. 2B, is secured only by the engagement of the interlocking elements.

In FIG. 1, a line of weakness is set along perforation axis 19 on a flange of the profile 16 prior to its attachment to the film. Alternatively, a line of weakness may also be set along perforation axis 20 prior to its attachment to the film, with the positioning of the perforation axis 20 illustrated in FIG. 2A. The lines of weakness may be perforations, dimples, scoring of the film, or any other tearing axes known to those skilled in the art. The positioning of the lines of weakness will hereinafter be referred to as on perforation axis 19, since perforation axis 20 is preferably collinear with perforation axis 19. Also, any tearing action or dimensioning regarding the present invention similarly affects perforation axis 20 as well as perforation axis 19. As such, perforation axes 19 and 20 are parallel to the interlocking profiles and end short of the longitudinal ends of the fastener strip, thereby protecting the lines of weakness from prematurely tearing open during the manufacturing process.

Sides 21 and 22 of thermoplastic film extending to the longitudinal film edges are provided on opposite sides of the fastener strip 14. In this regard the combined length of sides 21 and 22 is greater than that of the fastener strip to allow proper sealing, as will be discussed later. An area of weakness is created on the side 21 to align with the perforation axis 19 or to be to the right of and parallel with the fastener strip 14. The area of weakness may comprise an aperture 23, as shown in FIGS. 1–5, 14–18, or lines of weakness 80, 81, 84, 86, as shown in FIGS. 6–13, 20–33.

As shown in FIG. 1 the aperture 23, preferably elliptical, is cut or punched through the thermoplastic film 10 such that the longitudinal axis of the aperture 23 aligns with the perforation axis 19. The outer edge of aperture 23 should be in proximity to a longitudinal edge 24 of the thermoplastic film, but should also allow a sufficient buffer between the longitudinal edge to prevent the film from tearing to the aperture 23 from the longitudinal edge during the manufacturing process.

Figure 2A:
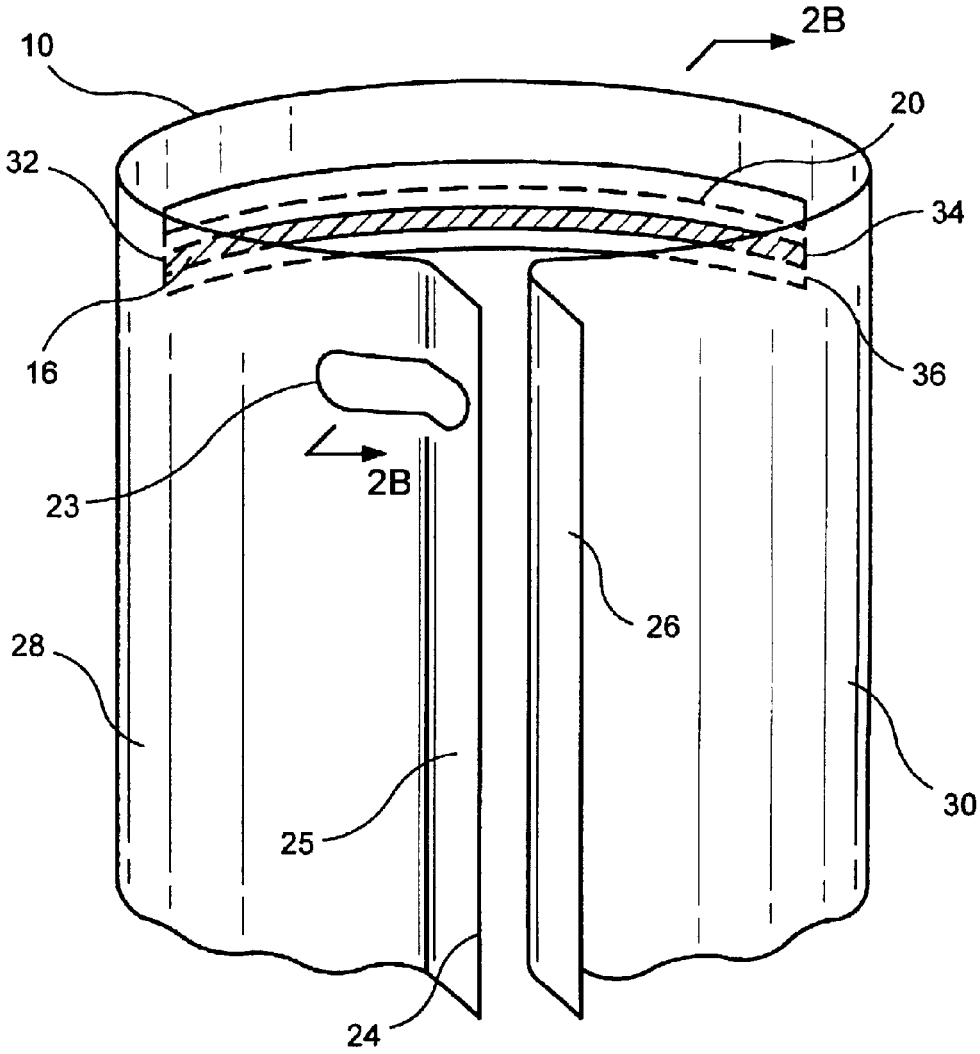
FIG. 2A is a side view depicting the first embodiment of the present invention wherein the thermoplastic film is folded to provide a fin seal area.
Figure 2B:
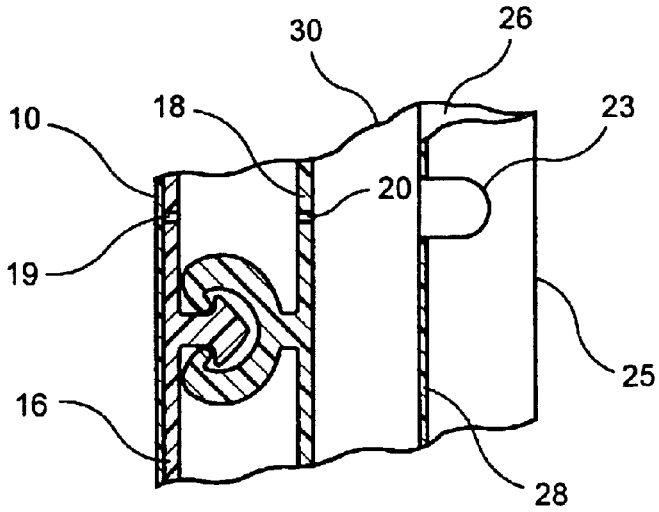
FIG. 2B is a sectional view depicting the first embodiment of the present invention taken from reference line 2B—2B of FIG. 2A.
Figure 3A:
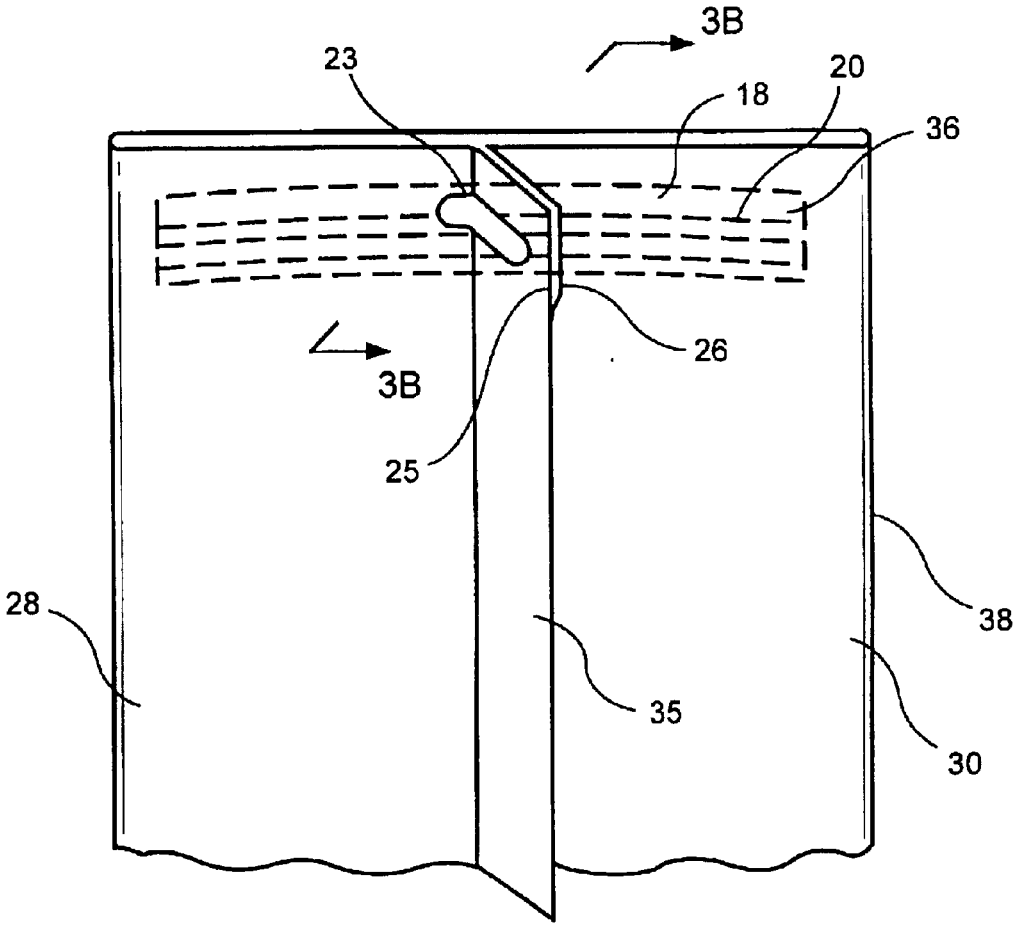
FIG. 3A is a side view depicting the first embodiment of the present invention wherein a fin seal has been formed at a cross-jaw section of a form-fill and seal machine.

As shown in FIGS. 2A and 2B, during the bag forming process the thermoplastic film 10 is folded on the form-fill and seal machine to bring side margins 25 and 26, respectively adjacent the longitudinal edges of the film, together in a fin to thereby form the thermoplastic film into a tube. The wall sections 28 and 30, corresponding to sides 21 and 22 that extend from the opposite ends 32 and 34 of the zipper strip, are joined by the fin to define a rear surface of the tube that faces the fastener strip 14. In FIG. 3A the side margins 25 and 26 are seamed together to form a fin seal 35, and a cross-jaw sealing section is used to seal wall sections 28 and 30 to the profile 18. When folding the film to form the fin seal 35, more than half of the aperture 23 should be on the side margin 25 with the remainder of the aperture on the adjacent wall section 28.

Figure 3B:
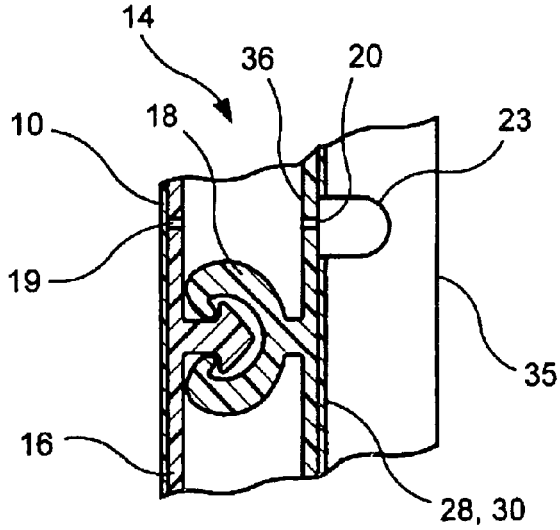
FIG. 3B is a sectional view depicting the first embodiment of the present invention taken from reference line 3B—3B of FIG. 3A.
Figure 4:
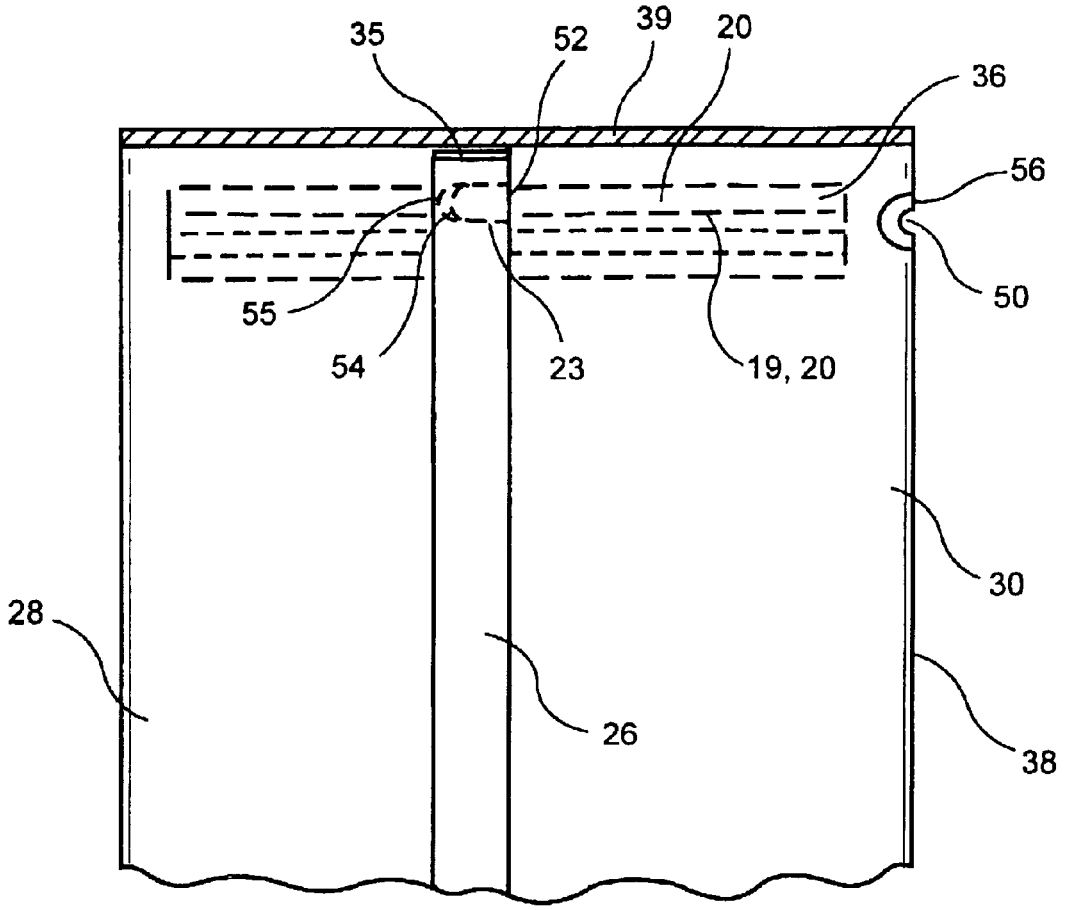
FIG. 4 is a side view depicting the first embodiment of the present invention wherein the fin seal has been sealed to a wall of the reclosable bag.

As shown in FIG. 3B, the use of the cross-jaw sealing section of a form-fill and seal machine (not shown) seals wall sections 28, 30 to an upper flange 36 of profile strip 18 of the fastener strip 14 while preferably avoiding pressure on the perforation axes 19 and 20. In FIG. 4, the thermoplastic film is folded into a tube with the fin seal 35 sealed to wall section 28. Because of the removed layers of the wall section 28 created by the aperture 23, the fin seal side margin 26 now seals directly to the upper flange 36 of the profile strip 18. The thermoplastic film is now formed as a reclosable bag 38 by forming a bottom cross-seal and a top cross-seal 39 above the profiles.

To assist in reaching the perforation axes 19, 20 of the reclosable bag 38 during an opening operation, a tear notch 50 is formed by cutting or melting away material from an edge of the reclosable bag 38. For the tear notch 50, the edge selected should be closer to the fold line 52 in the aperture than to the folded-over ends 54 and 55 of the aperture.

If a hermetic seal is necessary for the notch 50, a melting operation is used to form the notch. A peripheral melt zone 56 would join the front and rear walls of the package around the notch and hence would seal the contents of the interior of the reclosable bag from exposure via the notch.

Figure 5:
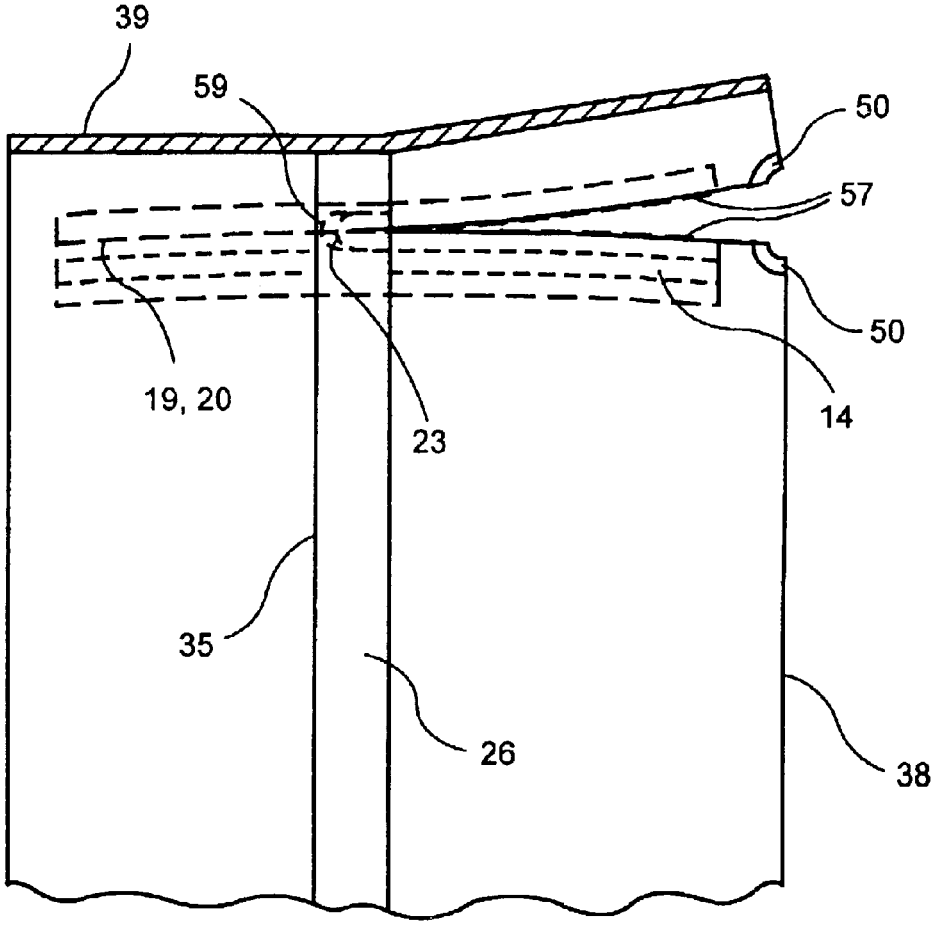
FIG. 5 is a side view depicting the first embodiment of the present invention with a reclosable bag shown in an opening condition.

FIG. 5 depicts the reclosable bag 38 in an opening condition. The notch 50 is separated by a tearing force produced by the user, thereby allowing the tearing force to continue to a resultant perforation 57 of the bag. As the tearing force proceeds, the hindrance of the fin seal 35 is reduced by exposed sealing areas 59 since the tearing force is exposed to only the side margin 26 of the fin seal.

Figure 6:
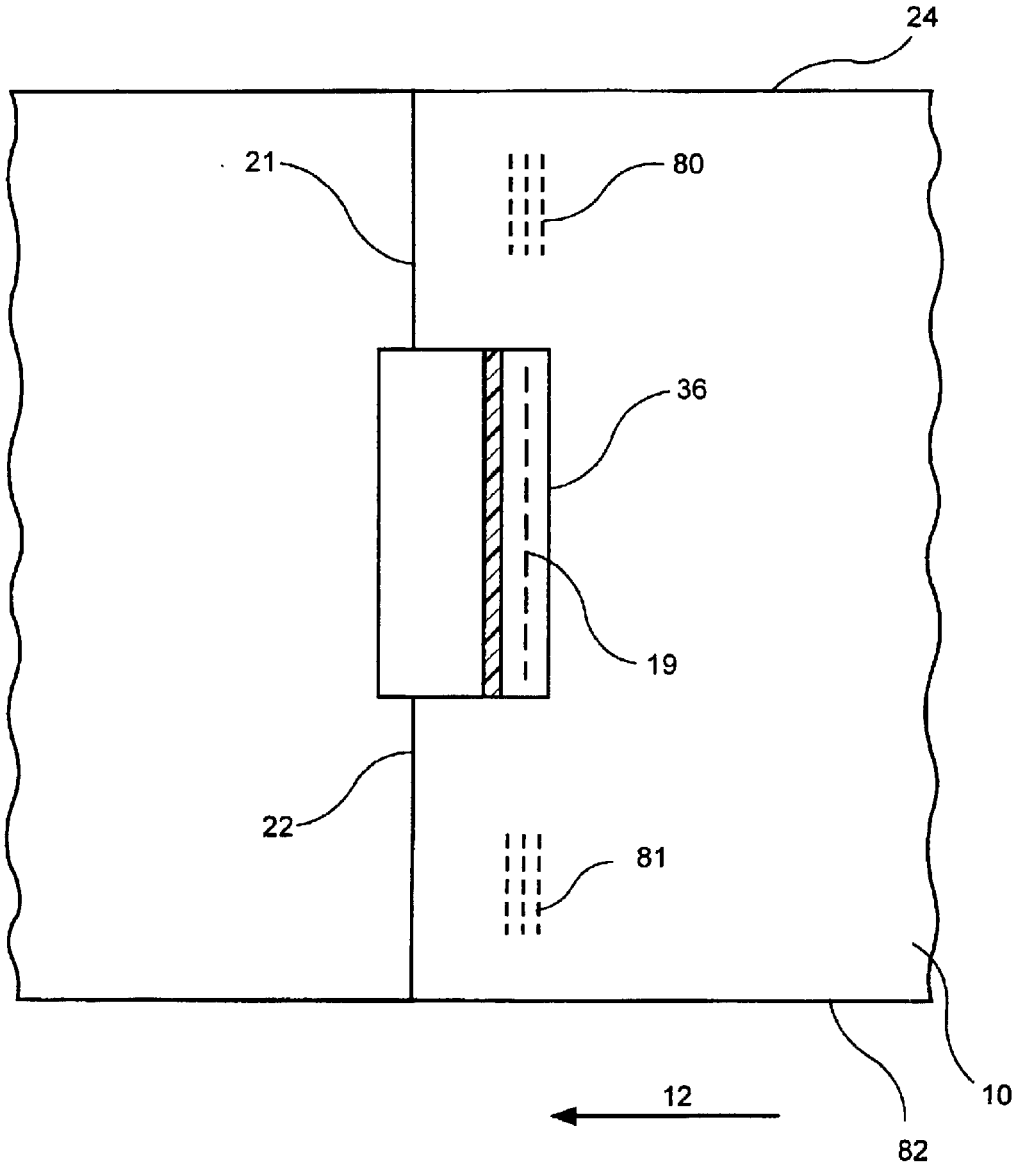
FIG. 6 is a plan view depicting a second embodiment of the present invention wherein a perforated fastener with adjacent multi-line perforated areas of weakness is formed on a section of thermoplastic film.

A second embodiment of the present invention is shown in FIG. 6. In the figure, the weakness area comprises a line of weakness 80 instead of the aperture 23. An opposing line of weakness 81 is positioned on the opposite side of the fastener 14. The lines of weakness 80, 81 may be a plurality of perforated lines on the film used to form the reclosable bag, a dimpling of the film, a scoring of the film, or any other tearing axis known to those skilled in the art. Shown as a plurality of perforated lines, the lines of weakness 80, 81 align with the perforation axis 19. The outer edge of the lines of weakness 80, 81 should be in proximity to the longitudinal edges 24, 82 of the film, but should also allow a sufficient buffer between the longitudinal edges to prevent the film from tearing to the lines of weakness from the longitudinal edges during the manufacturing process.

Figure 7A:
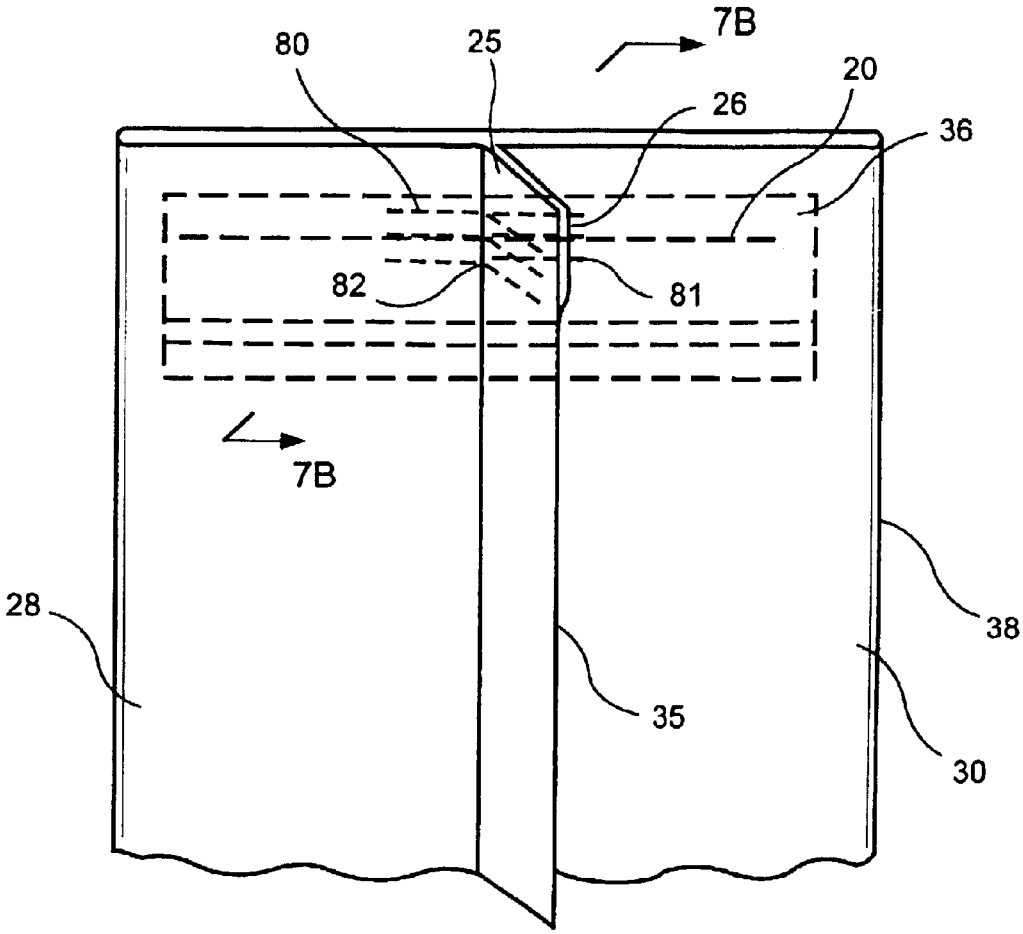
FIG. 7A is a side view depicting the second embodiment of the present invention wherein a fin seal has been formed at a cross-jaw section of a form-fill and seal machine.
Figure 7B:
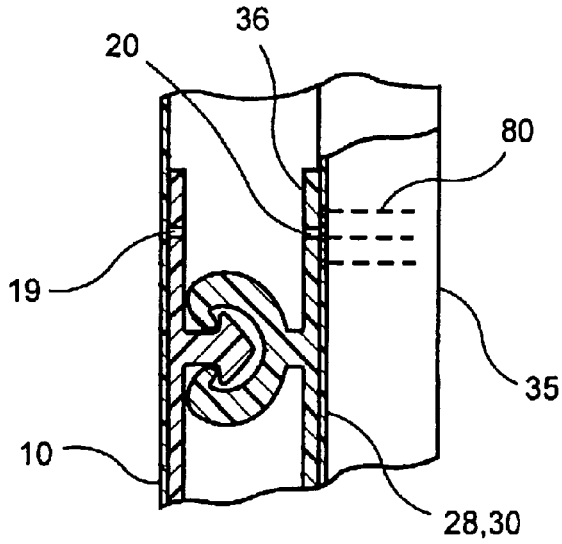
FIG. 7B is a sectional view depicting the second embodiment of the present invention taken from reference line 7B—7B of FIG. 7A.

Using the bag forming process described in FIGS. 2A and 3A, a bag with the fin seal 35 is shown in FIGS. 7A and 7B. When the wall sections 28 and 30 are folded to form the fin seal 35, more than half of the lines of weakness 80 should be on the side margin 25 with any remainder on the adjacent wall section 28. Similarly, more than half of the line of weakness 81 should be on the side margin 26 preferably in alignment with the line of weakness 80.

Figure 8:
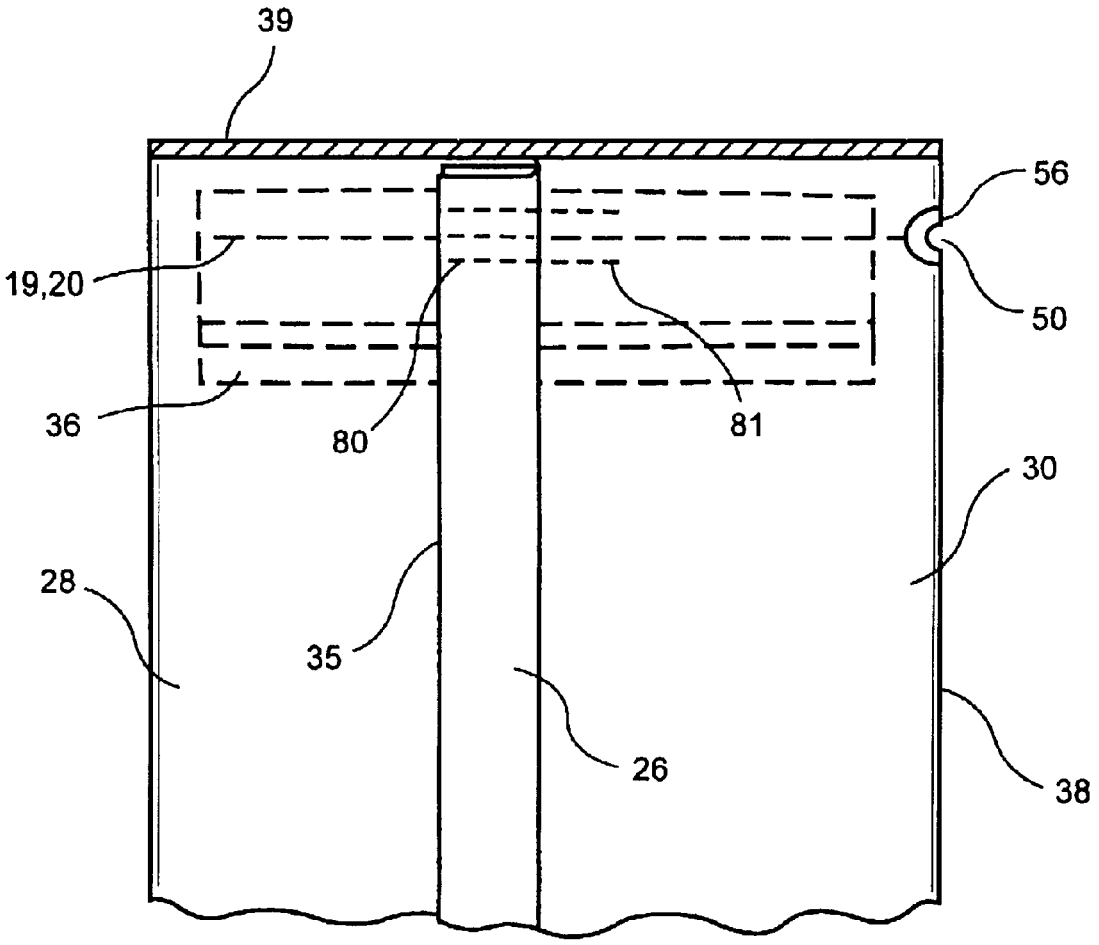
FIG. 8 is a side view depicting the second embodiment of the present invention wherein a reclosable bag has been formed.

In FIG. 8, the thermoplastic film is formed into a reclosable bag by the form-fill and seal machine. The wall sections 28 and 30 are sealed to the upper flange 36 while preferably avoiding pressure on the perforation axes 19 and 20. Alternatively, the line of weakness 81 can be applied on the wall section 30 and the side margin 26 after the fin seal is formed, instead of at the stage of manufacturing described earlier. The bottom cross-seal and the top cross-seal 39 are then formed, thereby creating the reclosable bag 38.

To assist in reaching the perforations of the reclosable bag 38 during an opening operation, the tear notch 50 is formed by cutting or melting away material from an edge of the reclosable bag 38. If a seal is necessary for the notch 50, a melting operation is used to form the notch. The peripheral melt zone 56 would join the front and rear walls of the package around the notch.

Figure 9:
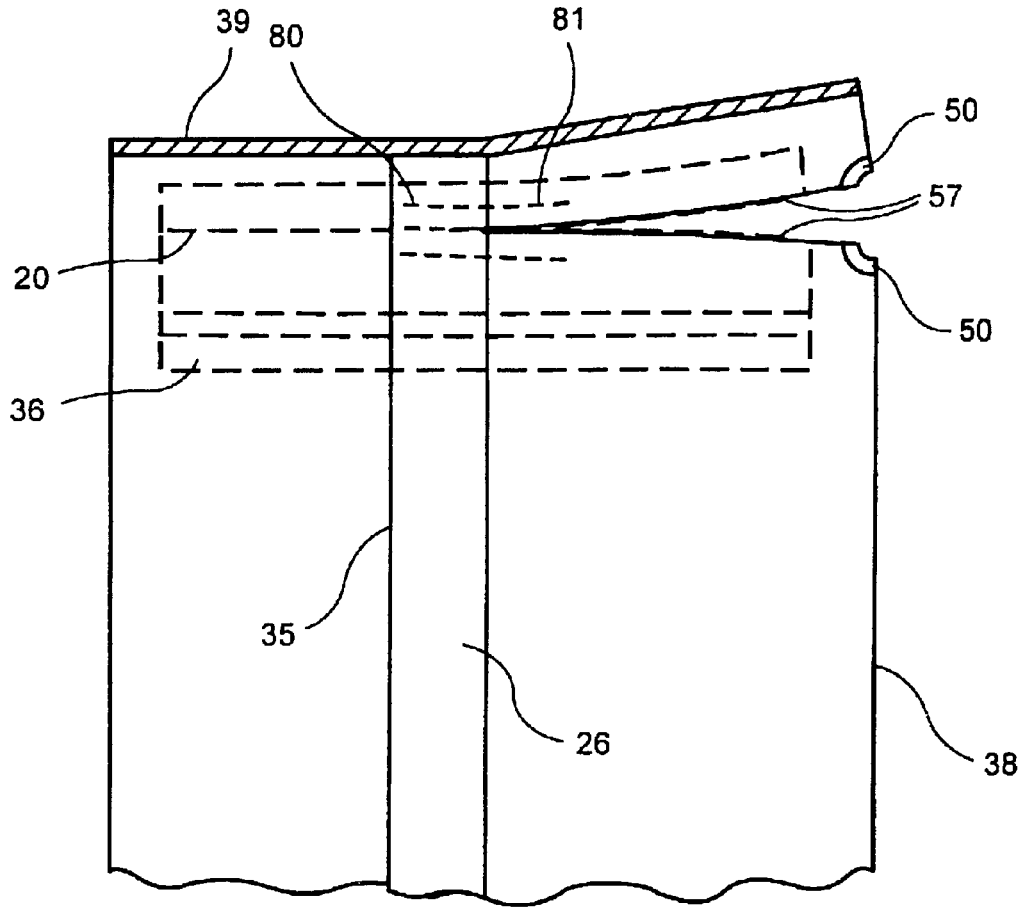
FIG. 9 is a side view depicting the second embodiment of the present invention with the reclosable bag shown in an opening condition.

FIG. 9 depicts the reclosable bag 38 in an opening condition. The notch 50 is separated by a tearing force produced by the user, allowing the tearing force to continue to a resultant perforation 57 of the bag. As the tearing force proceeds, the hindrance of the fin seal 35 is reduced by the lines of weakness 80, 81, since the lines of weakness produce a weakened layer of the fin seal 35.

Figure 10:
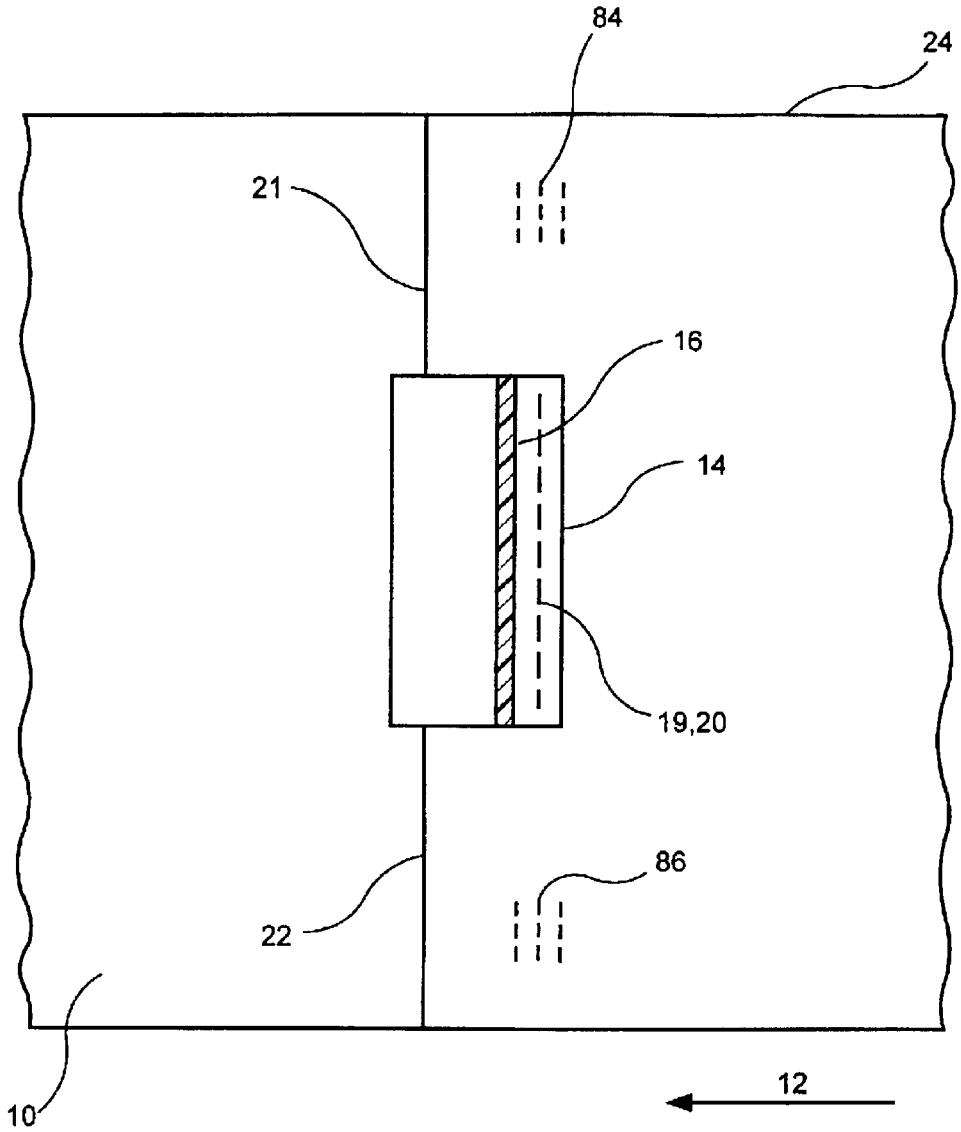
FIG. 10 is a plan view depicting a third embodiment of the present invention wherein a perforated fastener with adjacent multi-line perforated areas of weakness is formed on a section of thermoplastic film.

A third embodiment of the present invention is shown in FIG. 10. In the figure, a line of weakness 84 is created on side 21 of the film 10 with the line of weakness 84 less than half the length of the line of weakness 80. Additionally, a line of weakness 86 with a length less than half the length of the line of weakness 81 is created on side 22 of the film 10. Similar to the placements of lines of weakness 80, 81, the lines of weakness 84, 86 align with the perforation axes 19 and 20.

Figure 11:
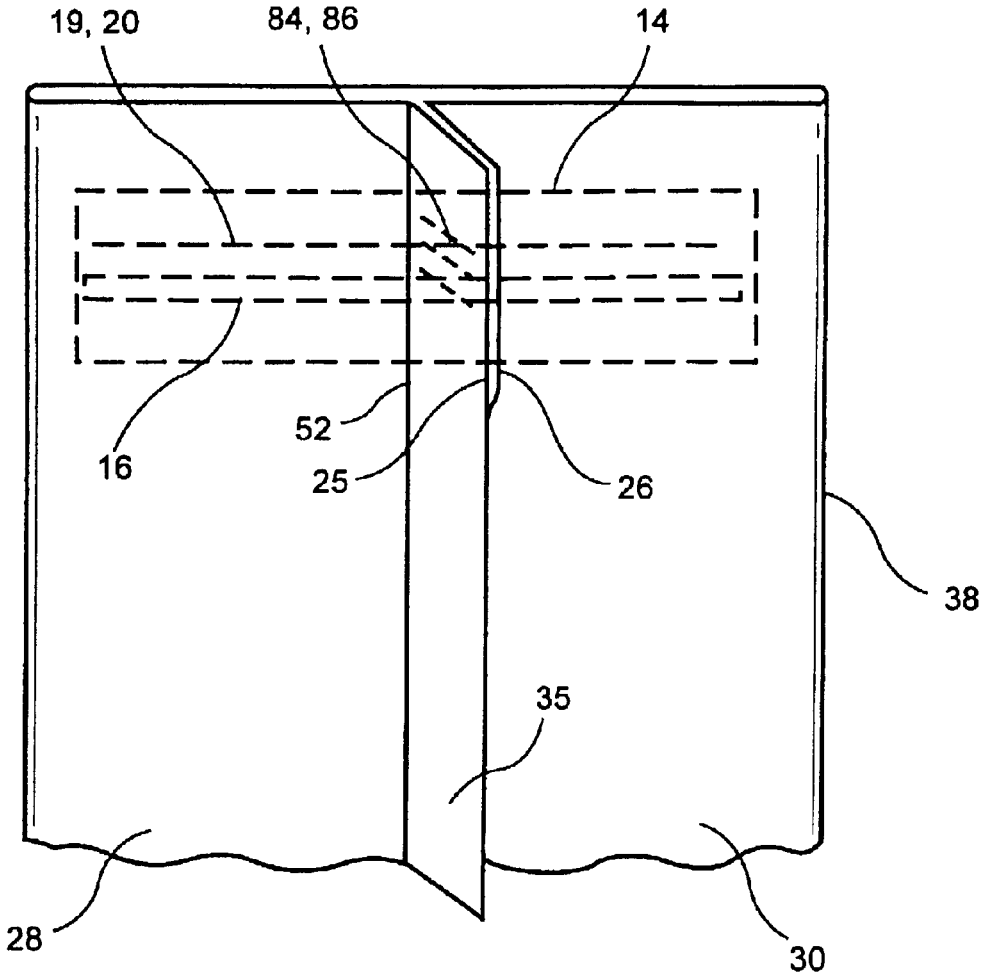
FIG. 11 is a side view depicting the third embodiment of the present invention wherein a fin seal has been formed at a cross-jaw section of a form-fill and seal machine.

Using the bag forming process described for FIGS. 2A and 3A, a bag with the fin seal is shown in FIG. 11. When the wall sections are folded to form the fin seal 35, lines of weakness 84, 86 should be fully on the fin seal with the lines of weakness ending short of the fold line 52 and with the lines of weakness preferably in alignment with each other. This positioning of the lines of weakness 84, 86 allows the resultant reclosable bag to be hermetically sealed since the lines of weakness are not on any bag wall.

Figure 12:
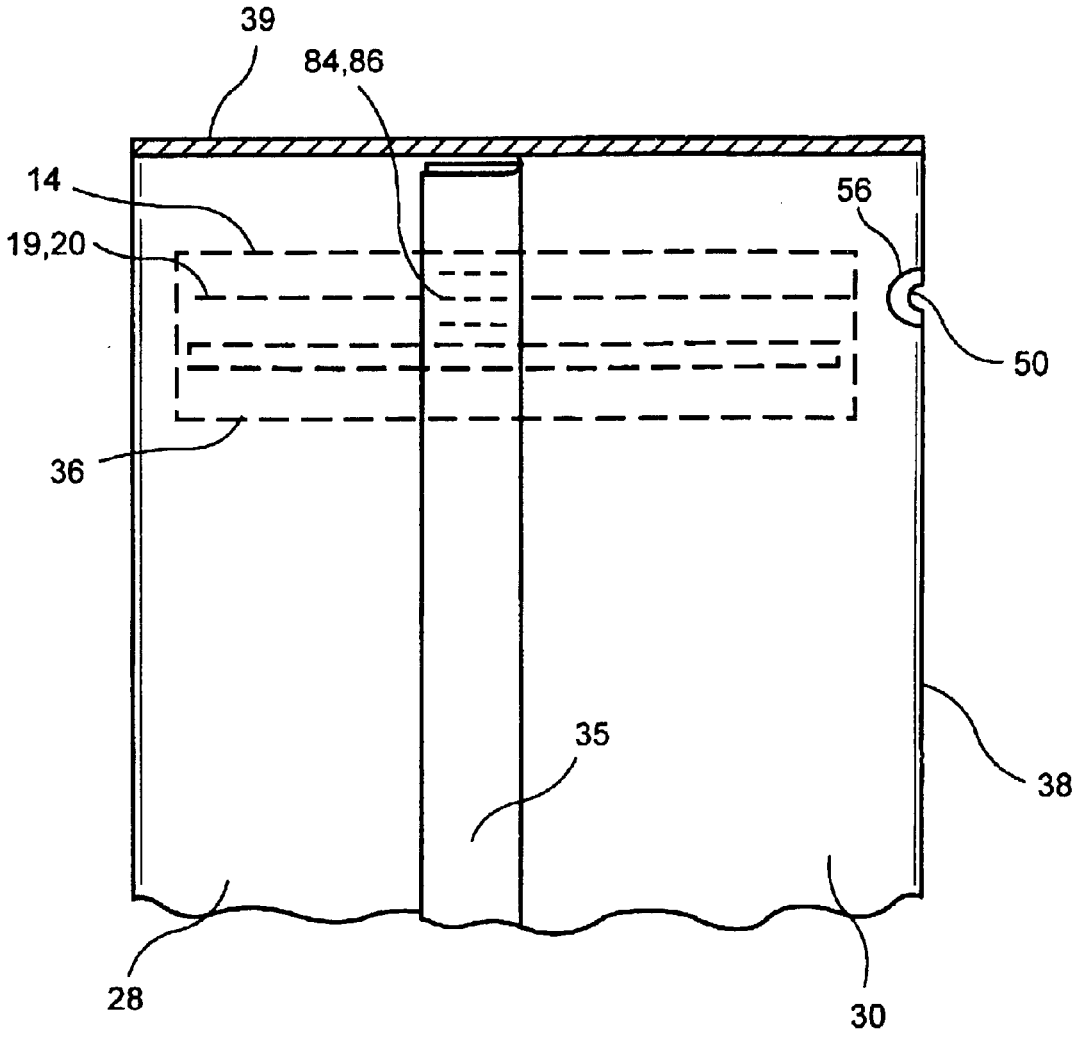
FIG. 12 is a side view depicting the third embodiment of the present invention wherein a reclosable bag has been formed.

In FIG. 12, the thermoplastic film for forming the bag is folded into a tube by the form-fill and seal machine. The wall sections 28 and 30 are sealed to the upper flange 36 while preferably avoiding pressure on the perforation axes 19, 20. Alternatively, the line of weakness 86 can be applied in the side margin 26 after the fin seal is formed, instead of at the stage of manufacturing described earlier. The bottom cross-seal and the top cross-seal 39 are then formed, thereby creating the reclosable bag 38. To assist in reaching the perforations, the tear notch 50 is formed by cutting or by melting away material from an edge of the reclosable bag 38. A melting operation is used to form a hermetic seal for the notch. The peripheral melt zone 56 joins the front and rear walls of the package around the notch and hence seals the contents of the interior of the reclosable bag 38 from exposure via the notch.

Figure 13:
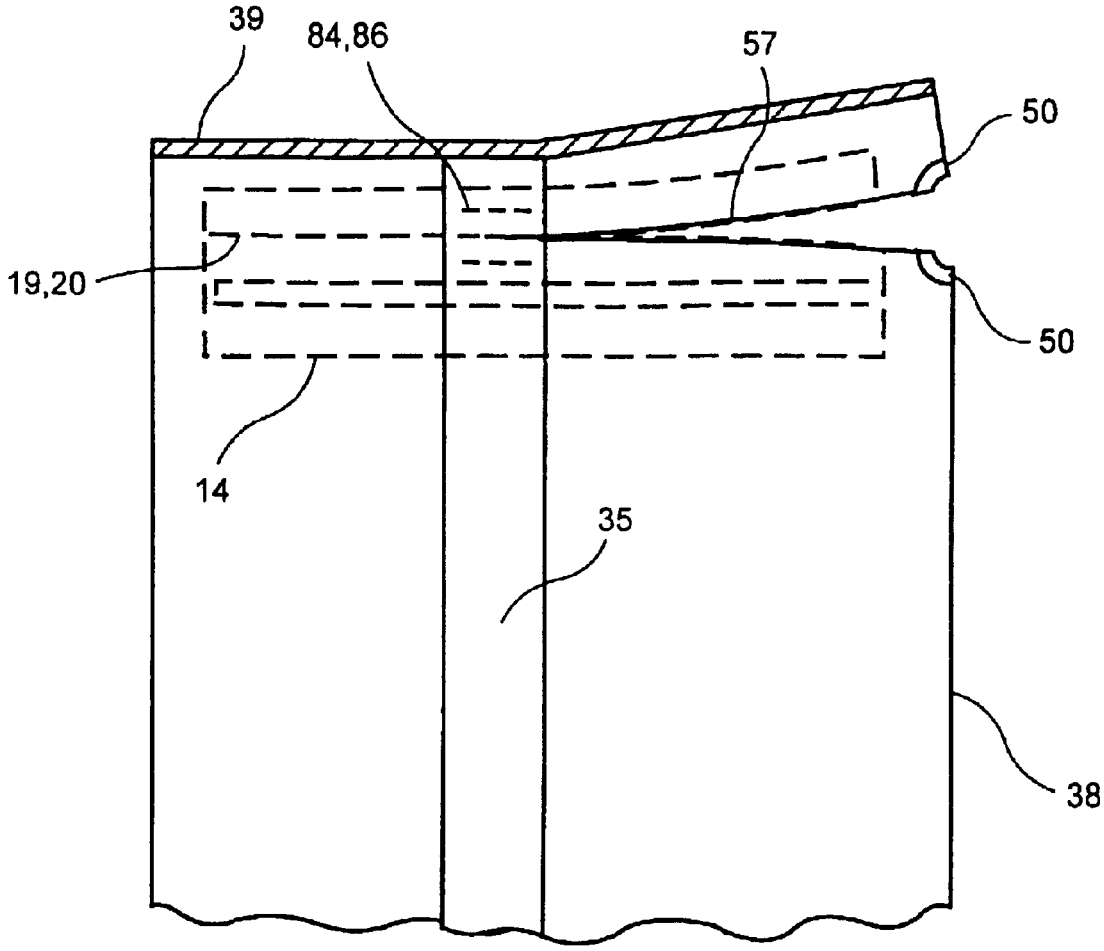
FIG. 13 is a side view depicting the third embodiment of the present invention with the reclosable bag shown in an opening condition.

FIG. 13 depicts the reclosable bag 38 in an opening condition. The notch 50 is separated by a tearing force produced by the user, allowing the tearing force to continue to the resultant perforation 57 of the bag. As the tearing force proceeds, the hindrance of the fin seal 35 is reduced by the lines of weakness 84, 86 as the tearing force encounters the weakened layers of the fin seal 35.

Figure 14:
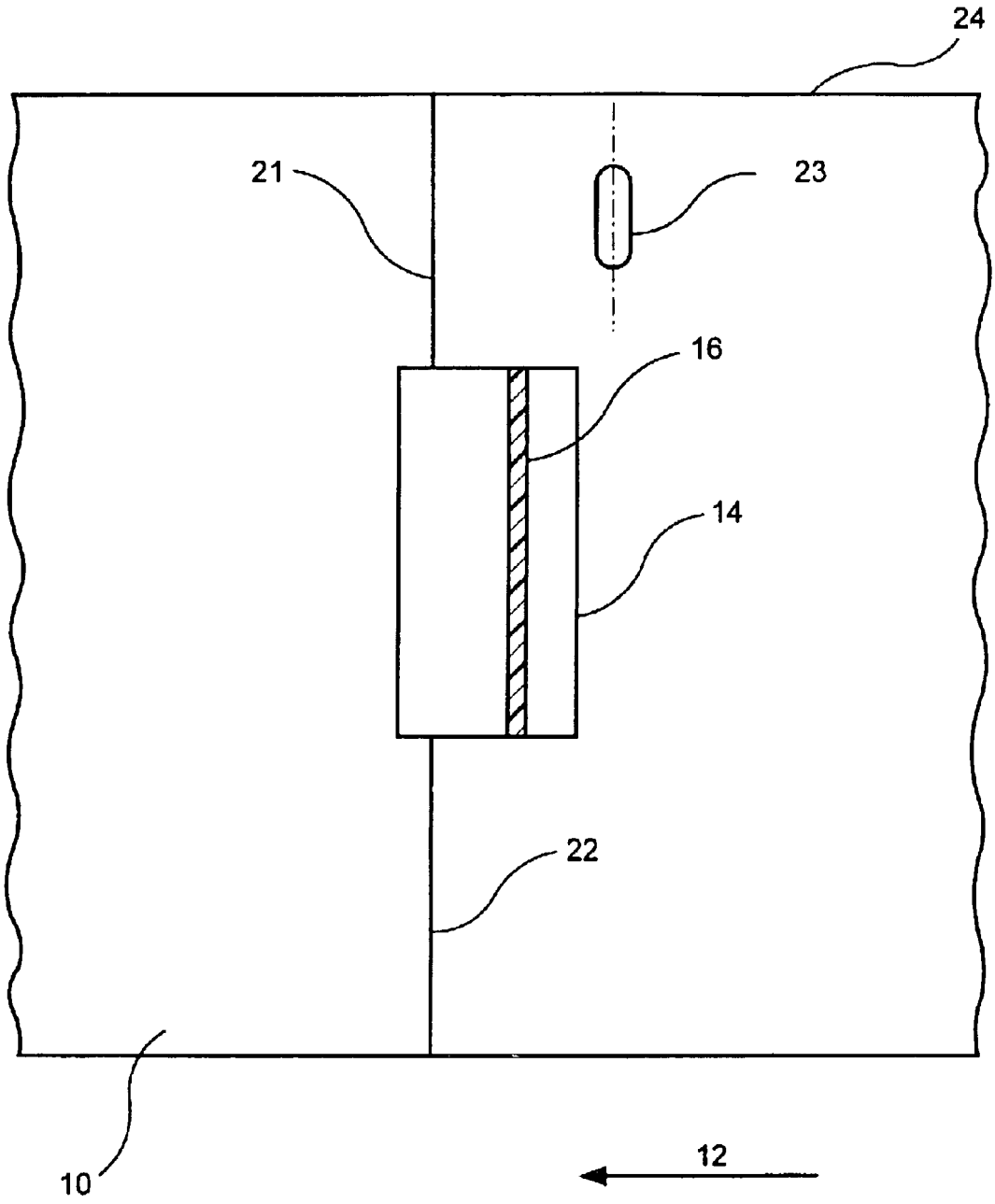
FIG. 14 is a plan view depicting a fourth embodiment of the present invention wherein a fastener with an adjacent elliptical aperture is formed on a section of thermoplastic film.

A fourth embodiment of the present invention is shown in FIG. 14. In the figure, the aperture 23 is cut or punched through the thermoplastic film 10 on the side 21 such that the longitudinal axis of the aperture aligns to an area to the right of and parallel with the fastener strip 14. The outer edge of the aperture 23 should be in proximity to the longitudinal edge 24 of the film, but should allow a sufficient buffer between the longitudinal edge to prevent the film from tearing to the aperture 23 from the longitudinal edge during the manufacturing process.

Figure 15:
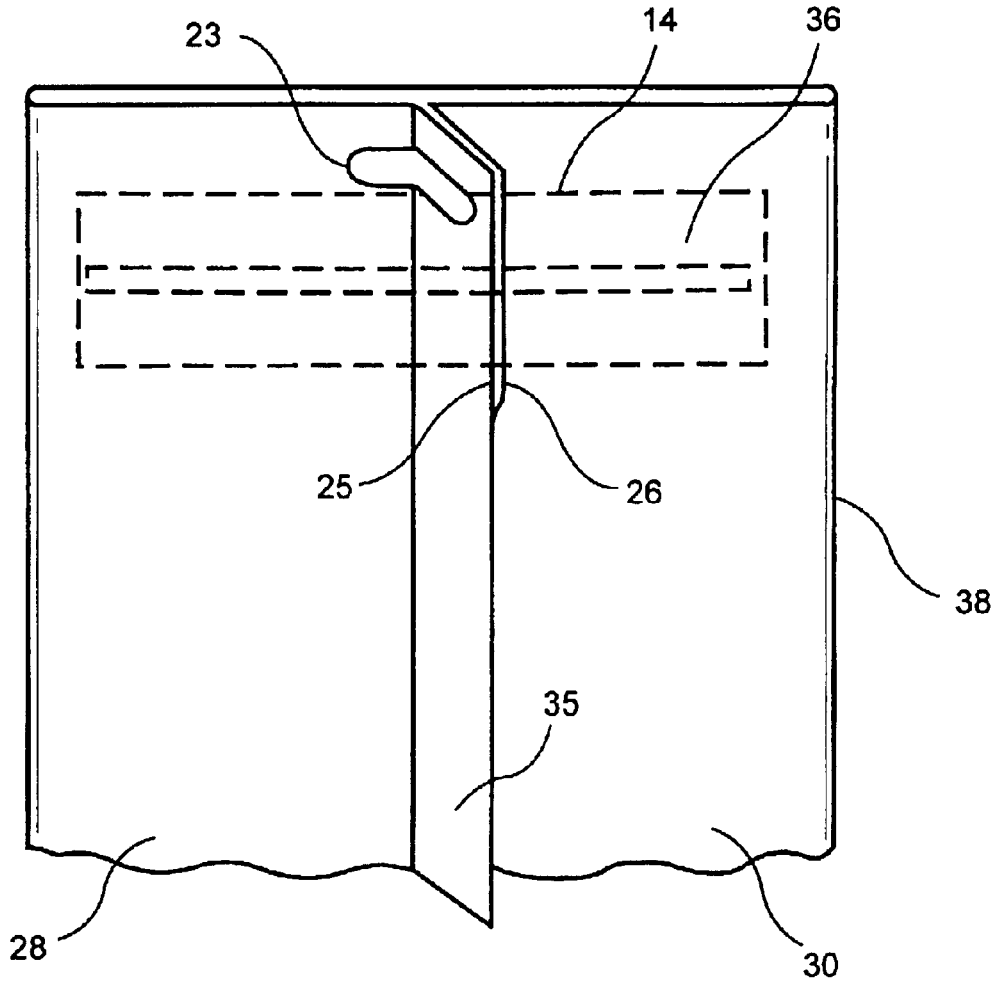
FIG. 15 is a side view depicting the fourth embodiment of the present invention wherein a fin seal has been formed at a cross-jaw section of a form-fill and seal machine.

Using the bag forming process described in FIGS. 2A and 3A, a bag with the fin seal 35 is shown in FIG. 15. When the wall sections 28, 30 are folded to form the fin seal 35, more than half of the aperture 23 should be on the side margin 25 with the remainder on the adjacent wall section 28. A cross-jaw sealing section of a form-fill and seal machine (not shown) seals the wall sections 28, 30 to an upper flange 36 of profile strip 18 of the fastener strip 14.

Figure 16:
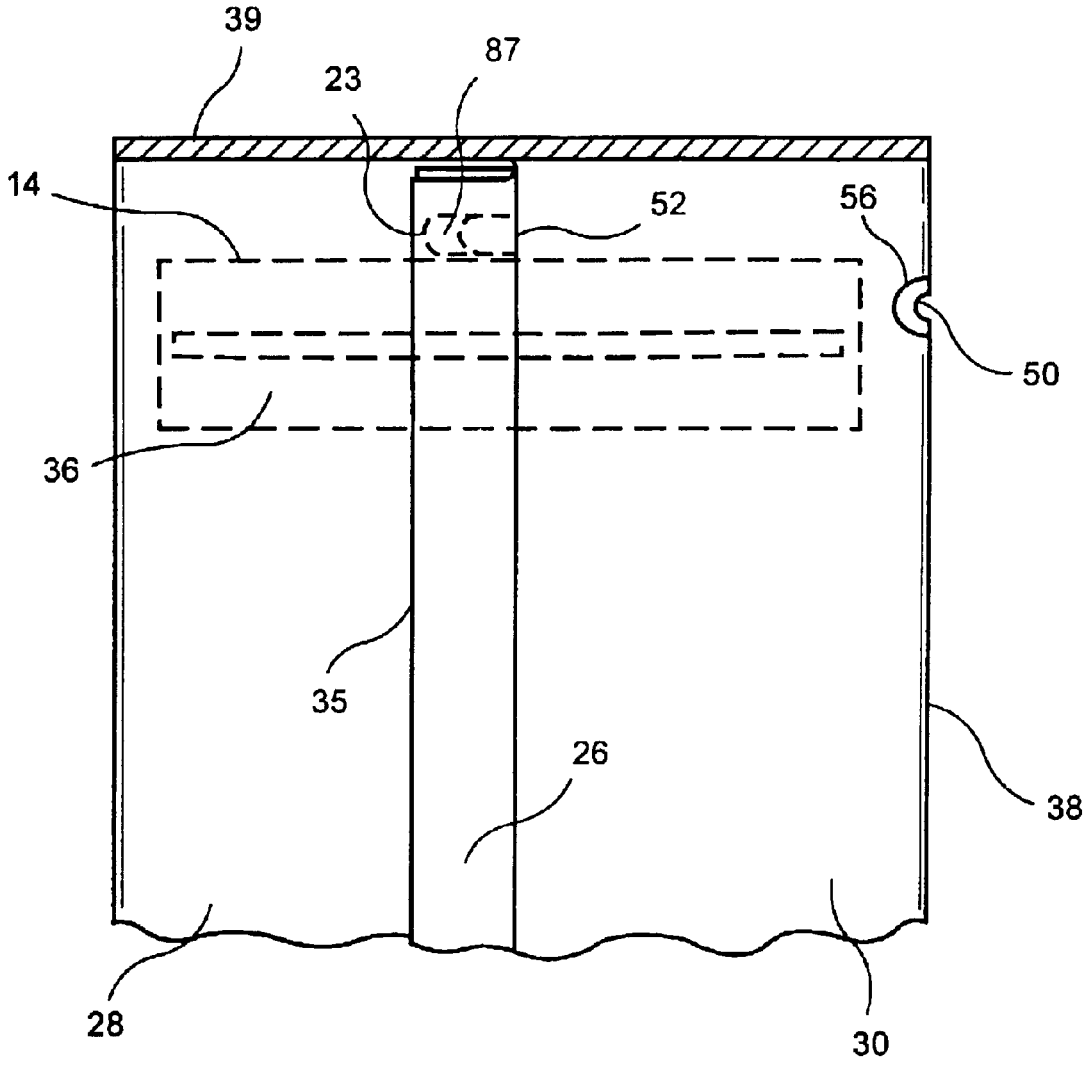
FIG. 16 is a side view depicting the fourth embodiment of the present invention wherein a reclosable bag has been formed with a tear notch on the edge of the reclosable bag.

In FIG. 16, the thermoplastic film for forming the bag is folded into a tube with the fin seal 35 sealed to wall section 28. Because of the removed layers of the wall section 28 created by the aperture 23, the fin seal margin 26 now seals directly to the thermoplastic film 10 of the interior bag wall 87 above the fastener strip 14. The thermoplastic film is now formed as a reclosable bag 38 by forming the bottom seal and the top cross-seal 39.

Figure 17:
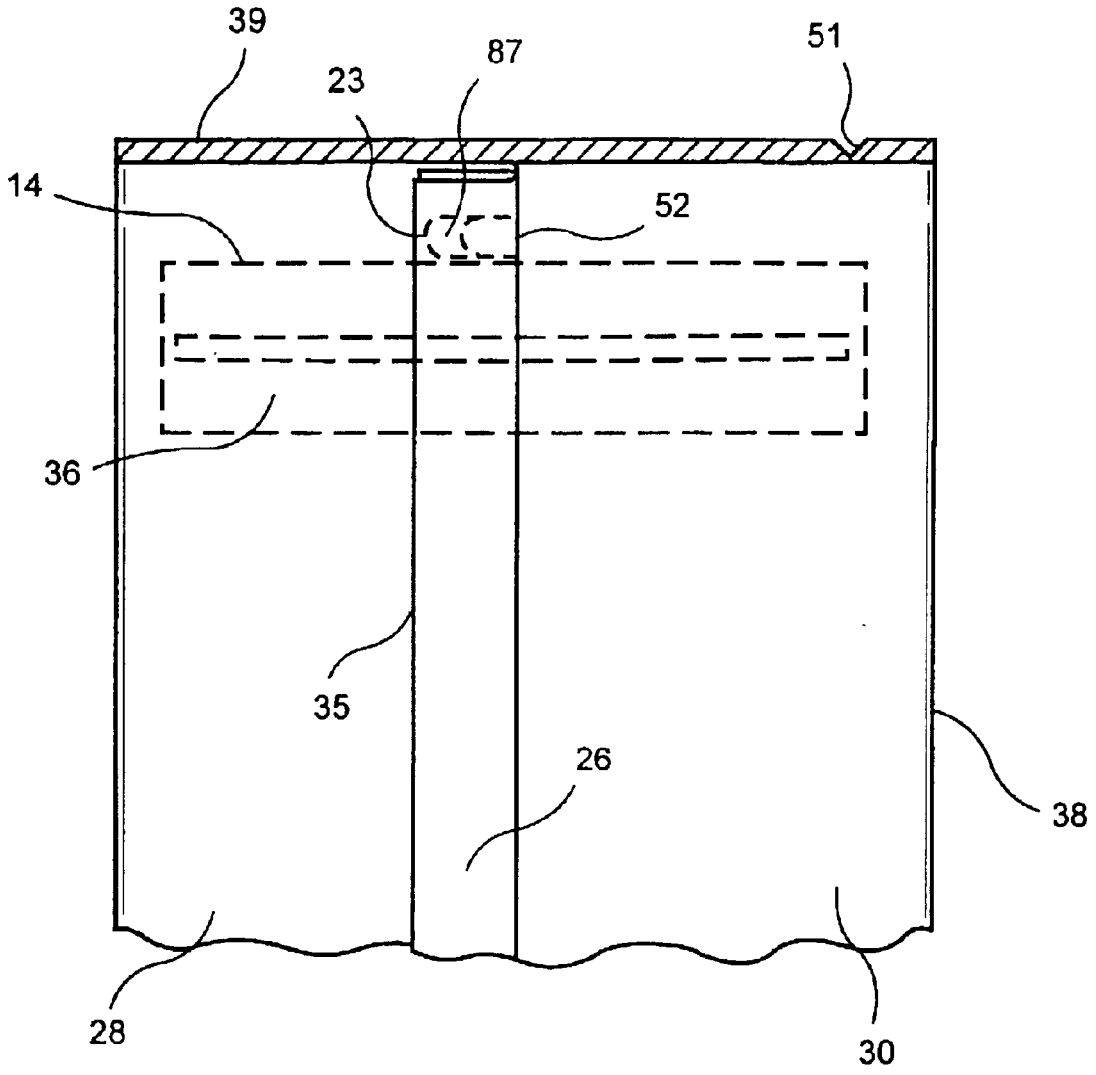
FIG. 17 is a side view depicting the fourth embodiment of the present invention wherein a reclosable bag has been formed with a tear notch formed in the cross-seal of the reclosable bag.

To assist in reaching the perforations of the reclosable bag 38 during an opening operation, the tear notch 50 is formed by cutting or melting away material from an edge of the reclosable bag 38. If a seal is necessary for the notch 50, a melting operation is used to form the notch. A peripheral melt zone 56 would join the front and rear walls of the package around the notch and hence would seal the contents of the interior of the reclosable bag from exposure via the notch. As shown in FIG. 17, the alternative tear notch 51 may be formed by cutting or melting away material from the top cross-seal 39. For the tear notches 50 and 51, the edge selected should be closest to the fold line 52.

Figure 18:
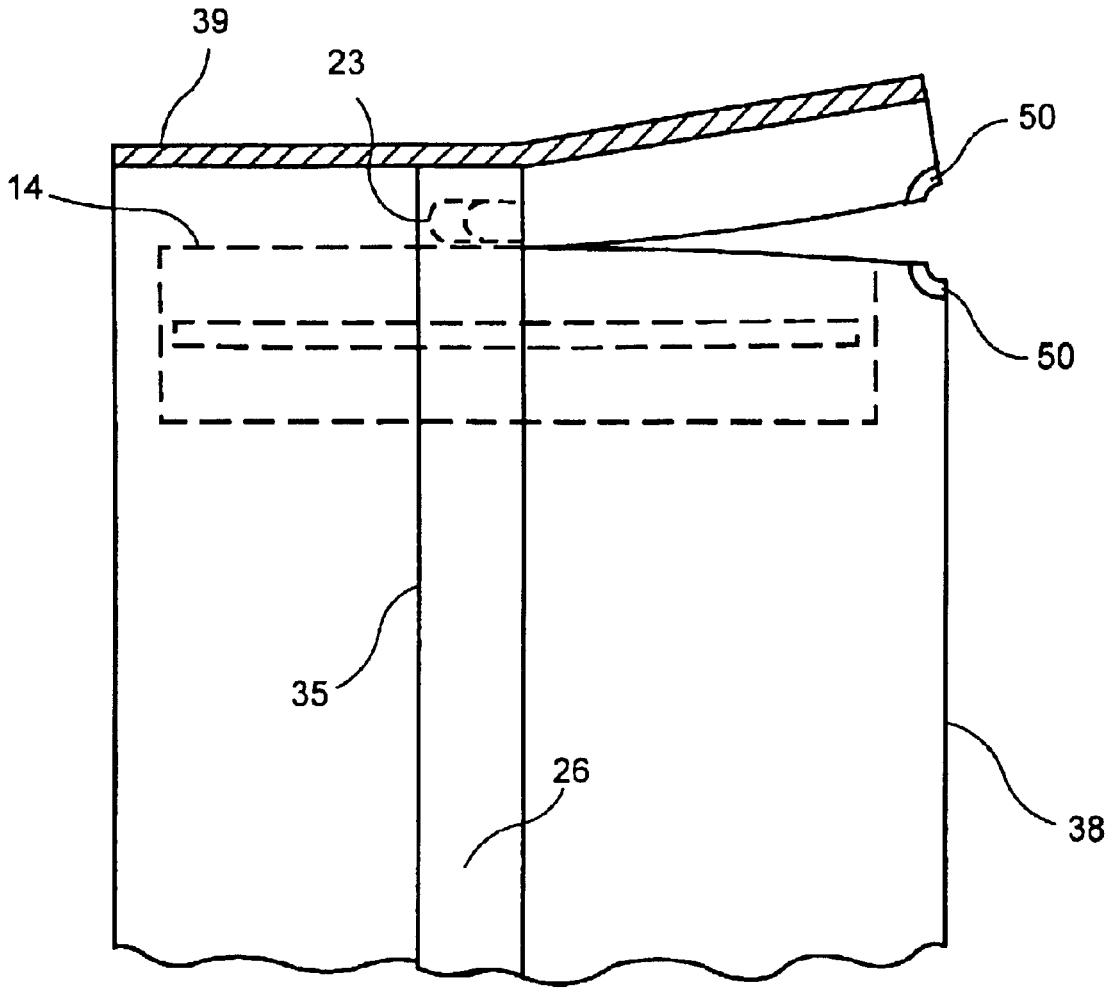
FIG. 18 is a side view depicting the fourth embodiment of the present invention with the reclosable bag shown in an opening condition.

FIG. 18 depicts the reclosable bag 38 in an opening condition. The notch 50 is separated by a tearing force produced by the user, thereby allowing the tearing force along the top of the fastener 14 to the aperture 23. The fastener 14 prevents the tear pattern from continuing down the length of the reclosable bag 38 and thereby prevents the package from being destroyed. As the tearing force proceeds, the hindrance of the fin seal 35 is reduced since the tearing force is exposed to only the side margin 26 of the fin seal. Once the tearing is complete, the flanges of the fastener strip 14 can be gripped by the user to open to the interior of the reclosable bag 38.

Figure 19:
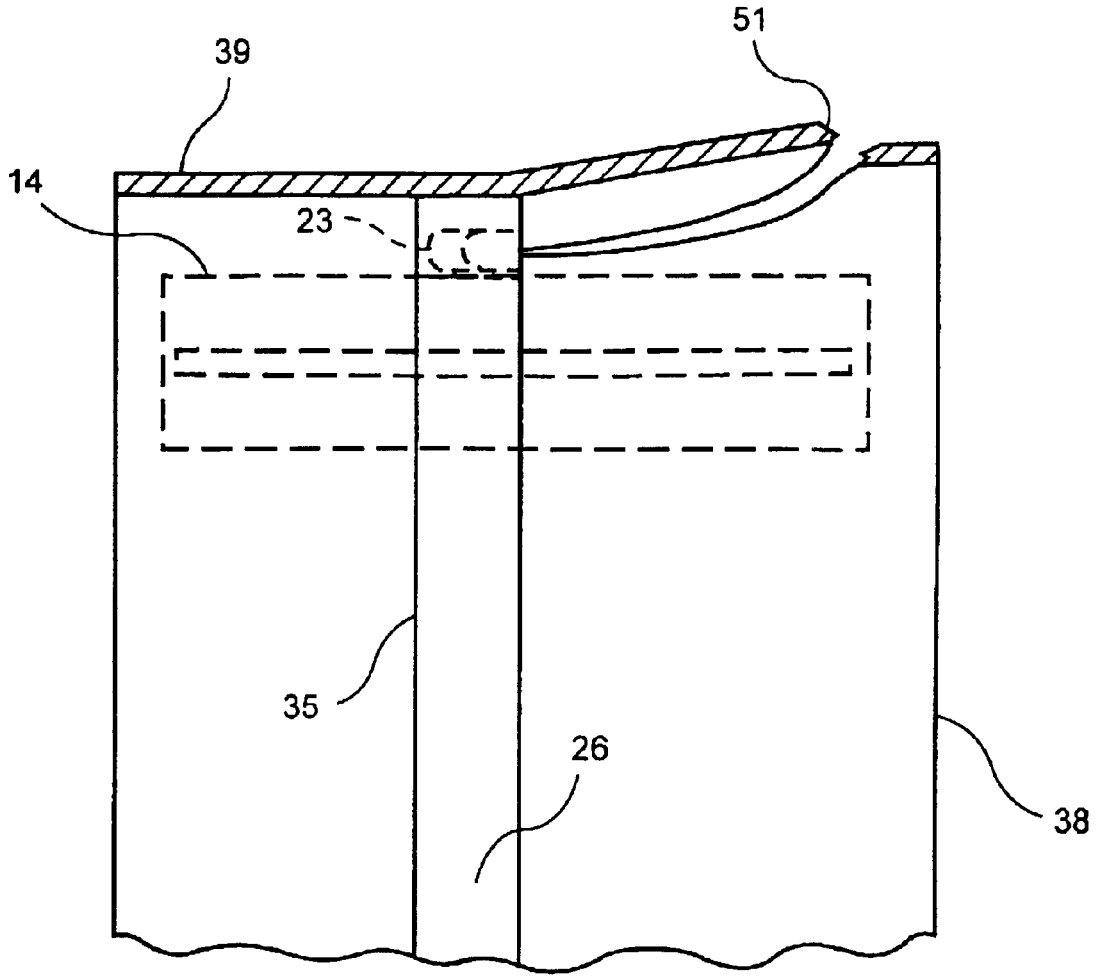
FIG. 19 is a side view depicting the fourth embodiment of the present invention with the reclosable bag shown in an alternative opening condition.

FIG. 19 depicts the reclosable bag 38 in an alternative opening condition using the tear notch 51. The notch 51 is separated by a tearing force produced by the user, thereby allowing the tearing force to proceed along the top of the fastener 14 to the aperture 23. The fastener 14 prevents the tear pattern from continuing down the length of the reclosable bag 38 and prevents the package from being destroyed. As the tearing force proceeds, the hindrance of the fin seal 35 is reduced since the tearing force is exposed to only the side margin 26 of the fin seal. Once the tearing is complete, the flanges of the fastener strip 14 can be gripped by the user to open to the interior of the reclosable bag 38.

Figure 20:
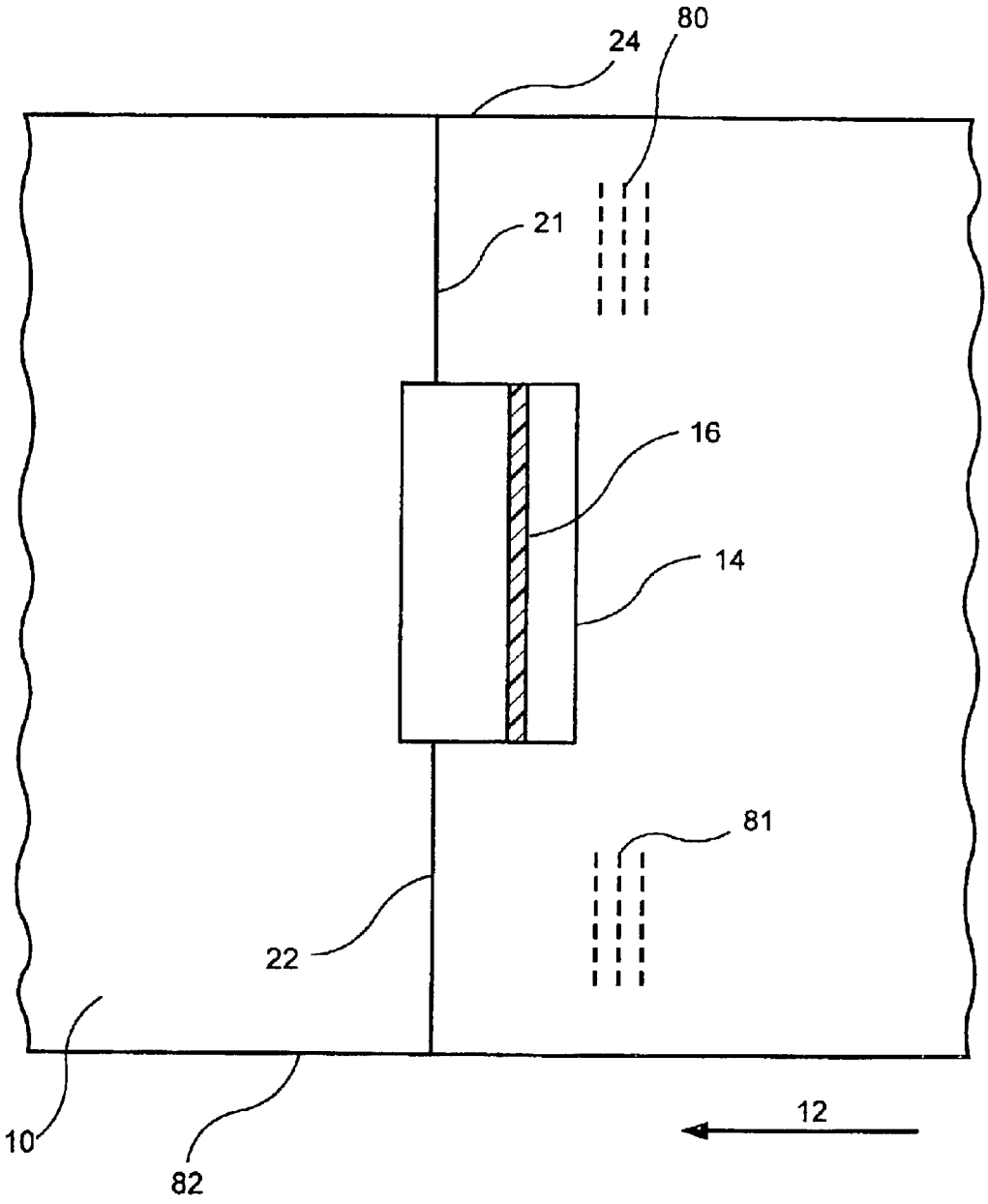
FIG. 20 is a plan view depicting a fifth embodiment of the present invention wherein a fastener with adjacent multi-line perforated areas of weakness is formed on a section of thermoplastic film.

A fifth embodiment of the present invention is shown in FIG. 20. In the figure, the lines of weakness 80, 81 align to an area to the right of and parallel with the fastener strip 14. The lines of weakness 80, 81 should be in proximity to the longitudinal edges 24, 82 of the film, but should also allow a sufficient buffer between the longitudinal edges to prevent the film from tearing to the lines of weakness from the longitudinal edges during manufacture.

Figure 21:
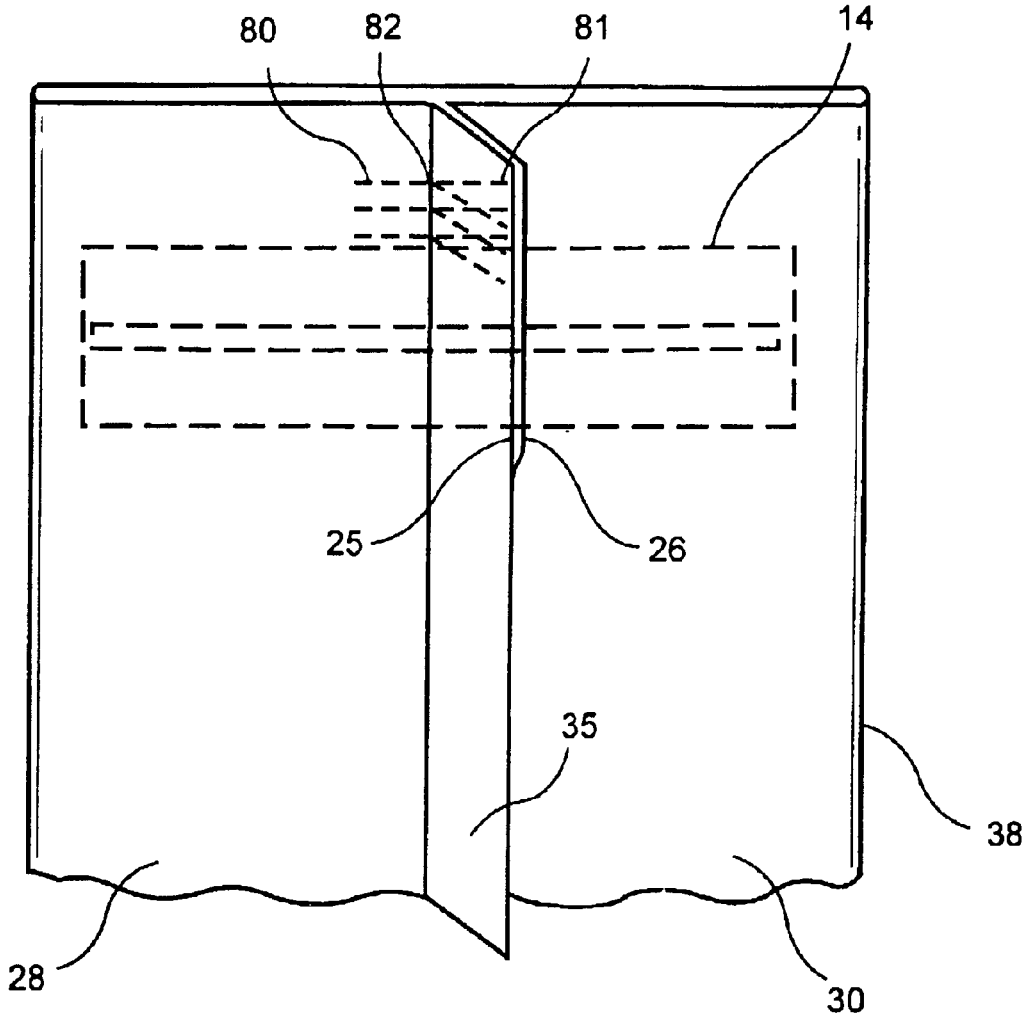
FIG. 21 is a side view depicting the fifth embodiment of the present invention wherein a fin seal has been formed at a cross-jaw section of a form-fill and seal machine.

Using the bag forming process described in FIGS. 2A and 3A, a bag with the fin seal 35 is shown in FIG. 21. When the wall sections 28 and 30 are folded to form the fin seal 35, more than half of the line of weakness 80 should be on the side margin 25 with the remainder on the adjacent wall section 28. Similarly, more than half of the line of weakness 81 should be on the side margin 26 preferably in alignment with the line of weakness 80.

Figure 22:
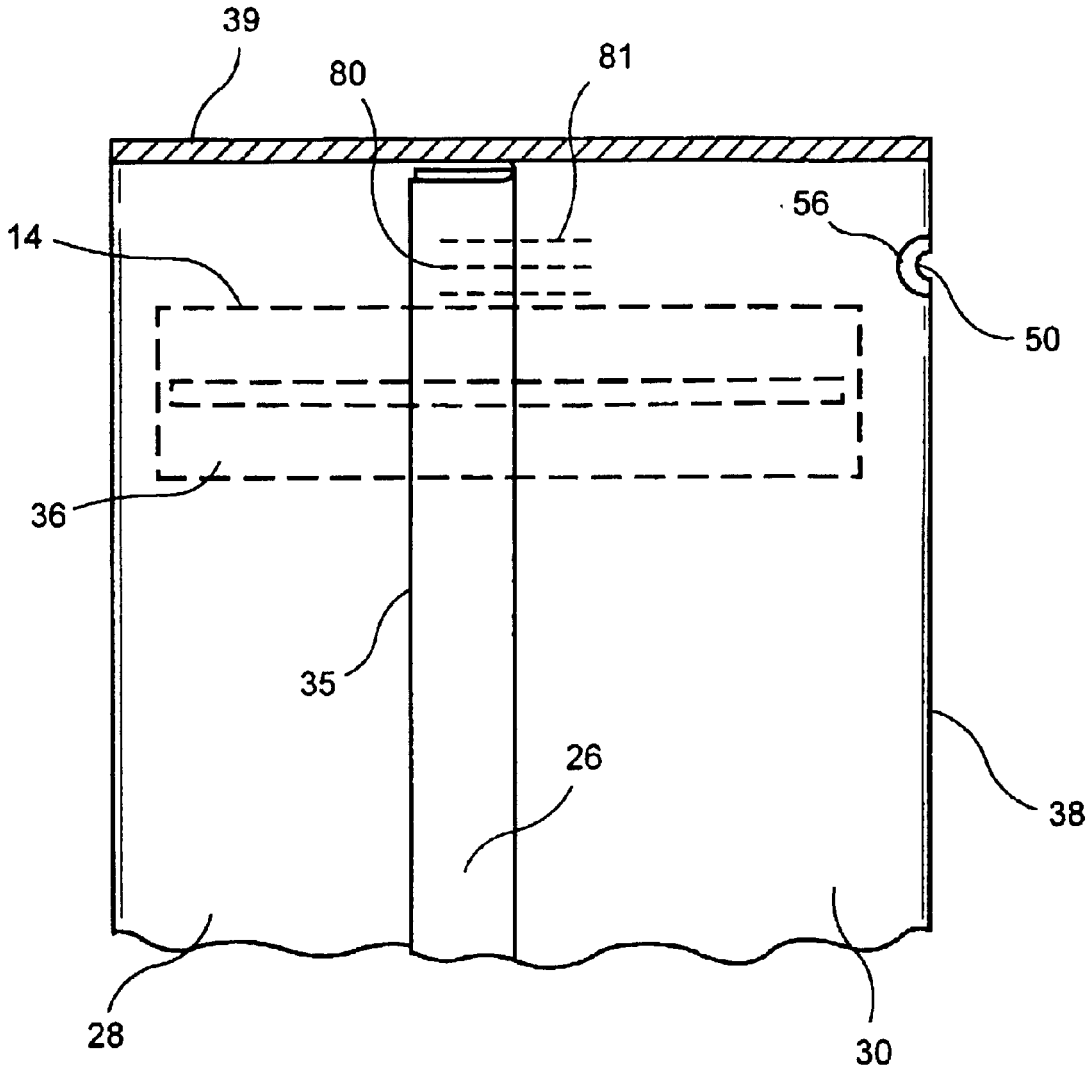
FIG. 22 is a side view depicting the fifth embodiment of the present invention wherein a reclosable bag has been formed with a tear notch on the edge of the reclosable bag.

In FIG. 22, the thermoplastic film for forming the bag is folded into a tube with a fin seal 35 by the form-fill and seal machine. The wall sections 28 and 30 are sealed to the upper flange 36. Alternatively the line of weakness 81 can be applied in the side margin 26 after the fin seal 35 is formed, instead of at the stage of manufacturing described earlier. The bottom cross-seal and the top cross-seal 39 are formed, thereby creating the reclosable bag 38.

Figure 23:
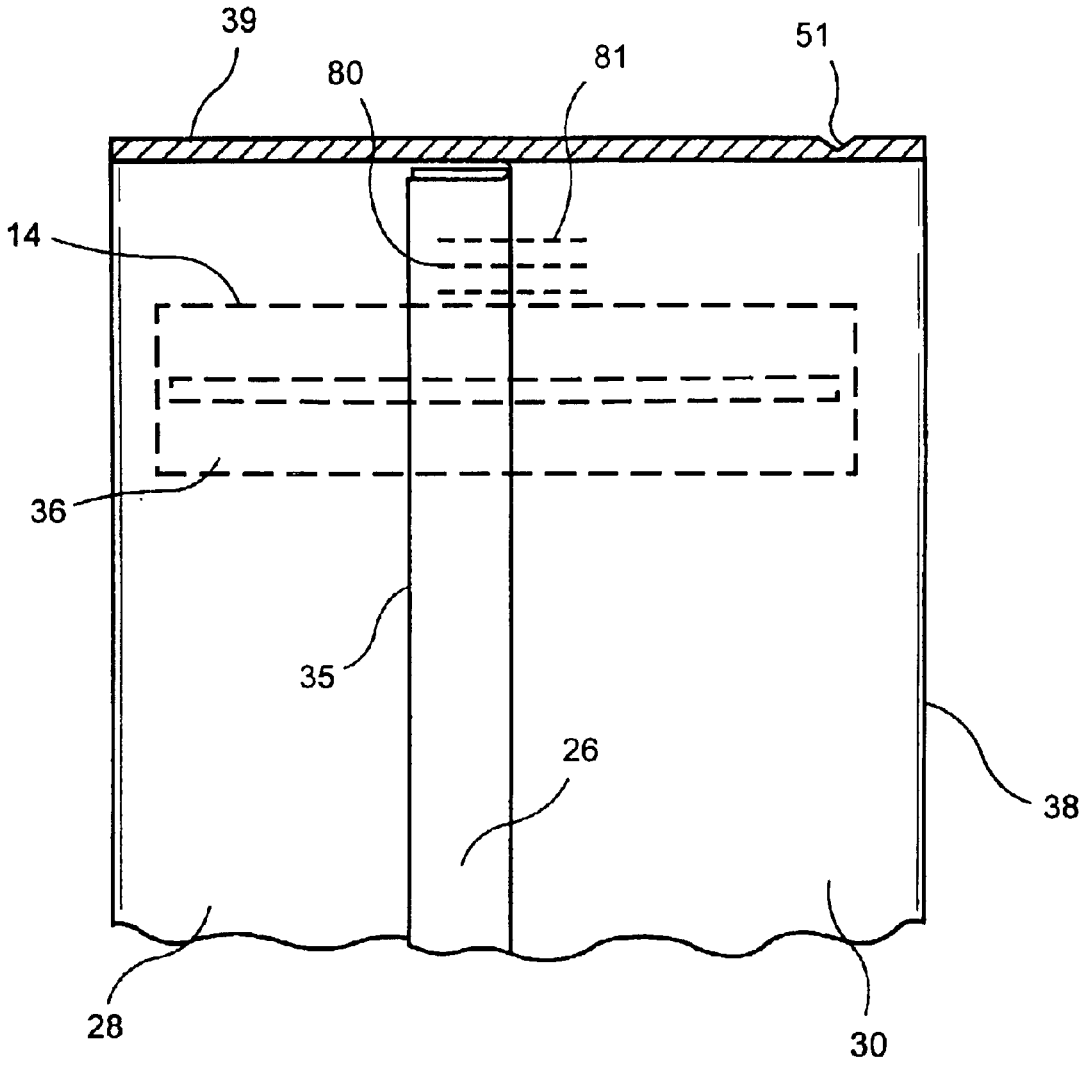
FIG. 23 is a side view depicting the fifth embodiment of the present invention wherein a reclosable bag has been formed with a tear notch formed in the cross-seal of the reclosable bag.

To assist in reaching the perforations of the reclosable bag 38 during an opening operation, the tear notch 50 is formed by cutting or melting away material from an edge of the reclosable bag 38. If a seal is necessary for the notch 50, a melting operation is used to form the notch. A peripheral melt zone 56 would join the front and rear walls of the package around the notch 50 and hence would seal the contents of the interior of the reclosable bag from exposure via the notch. As shown in FIG. 23, the alternative tear notch 51 may be formed by cutting or melting away material from the top cross-seal 39.

Figure 24:
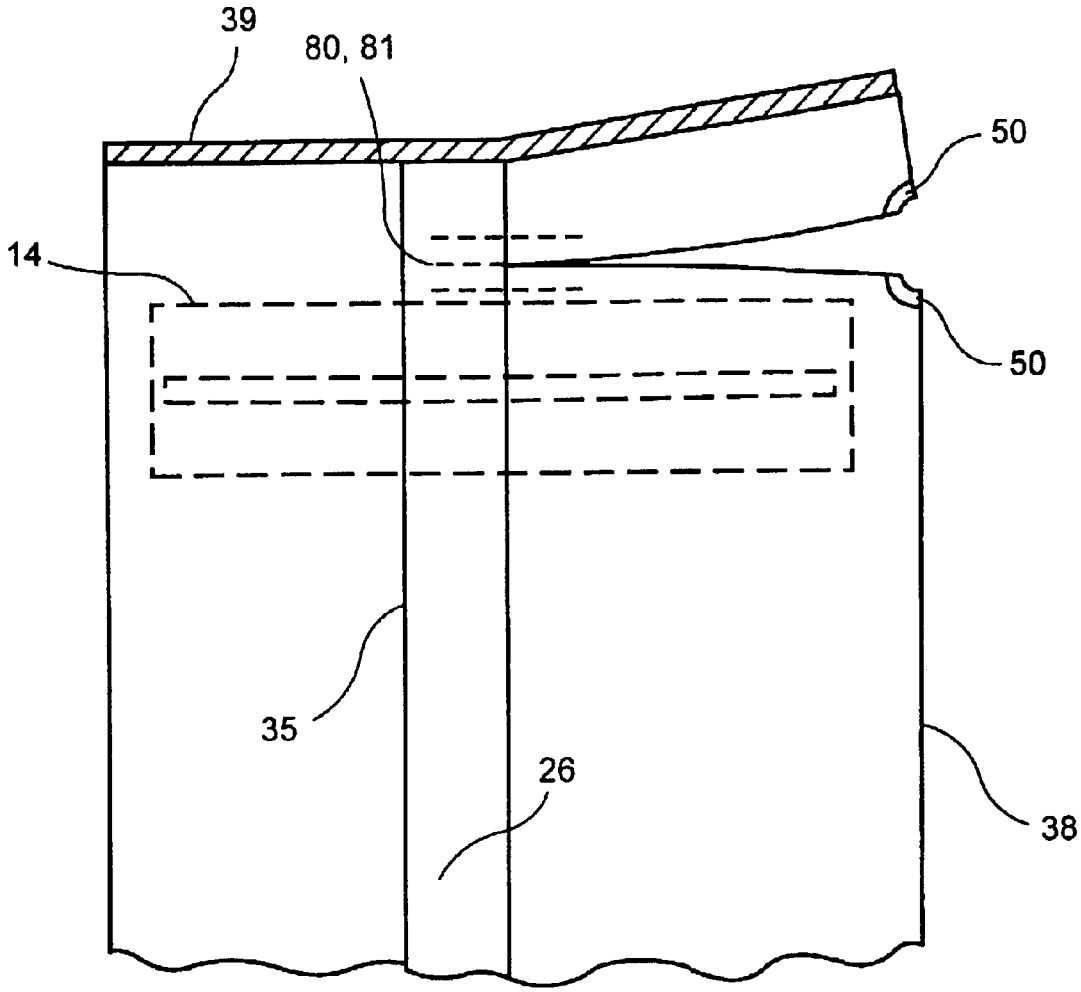
FIG. 24 is a side view depicting the fifth embodiment of the present invention with the reclosable bag shown in an opening condition.

FIG. 24 depicts the reclosable bag 38 in an opening condition. The notch 50 is separated by a tearing force produced by the user, thereby allowing the tearing force along the top of the fastener 14 to the lines of weakness 80, 81. The fastener 14 prevents the tear pattern from continuing down the length of the reclosable bag 38 and thereby prevents the package from being destroyed. As the tearing force proceeds, the hindrance of the fin seal 35 is reduced since the tearing force is exposed to the lines of weakness. Once the tearing is complete, the flanges of the fastener strip 14 can be gripped by the user to open to the interior of the reclosable bag 38.

Figure 25:
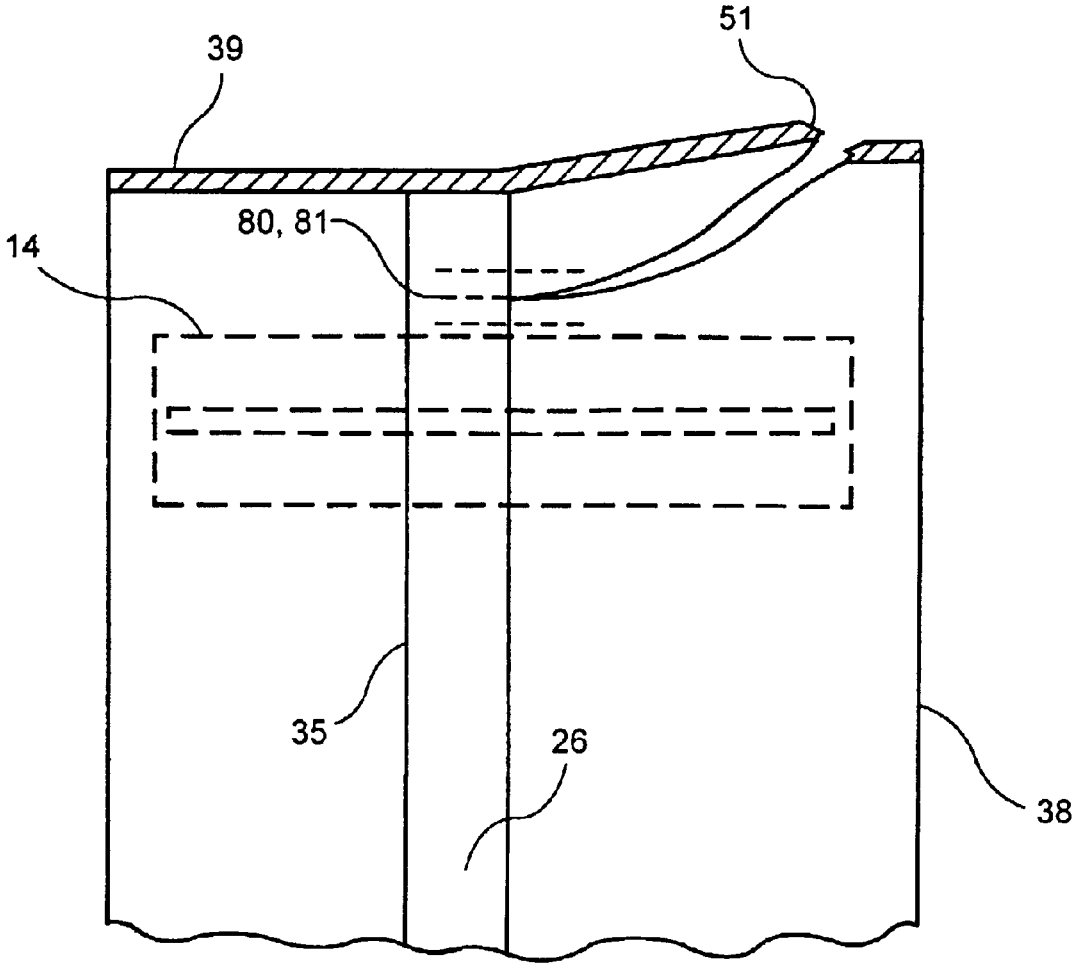
FIG. 25 is a side view depicting the fifth embodiment of the present invention with the reclosable bag shown in an alternative opening condition.

FIG. 25 depicts the reclosable bag 38 in an alternative opening condition using the tear notch 51. The notch 51 is separated by a tearing force produced by the user, thereby allowing the tearing force along the top of the fastener 14 to the lines of weakness 80, 81. The fastener 14 prevents the tear pattern from continuing down the length of the reclosable bag 38 and thereby prevents the package from being destroyed. As the tearing force proceeds, the hindrance of the fin seal 35 is reduced since the tearing force is exposed to the lines of weakness 80, 81 on the fin seal. Once the tearing is complete, the flanges of the fastener strip 14 can be gripped by the user to open to the interior of the reclosable bag 38.

Figure 26:
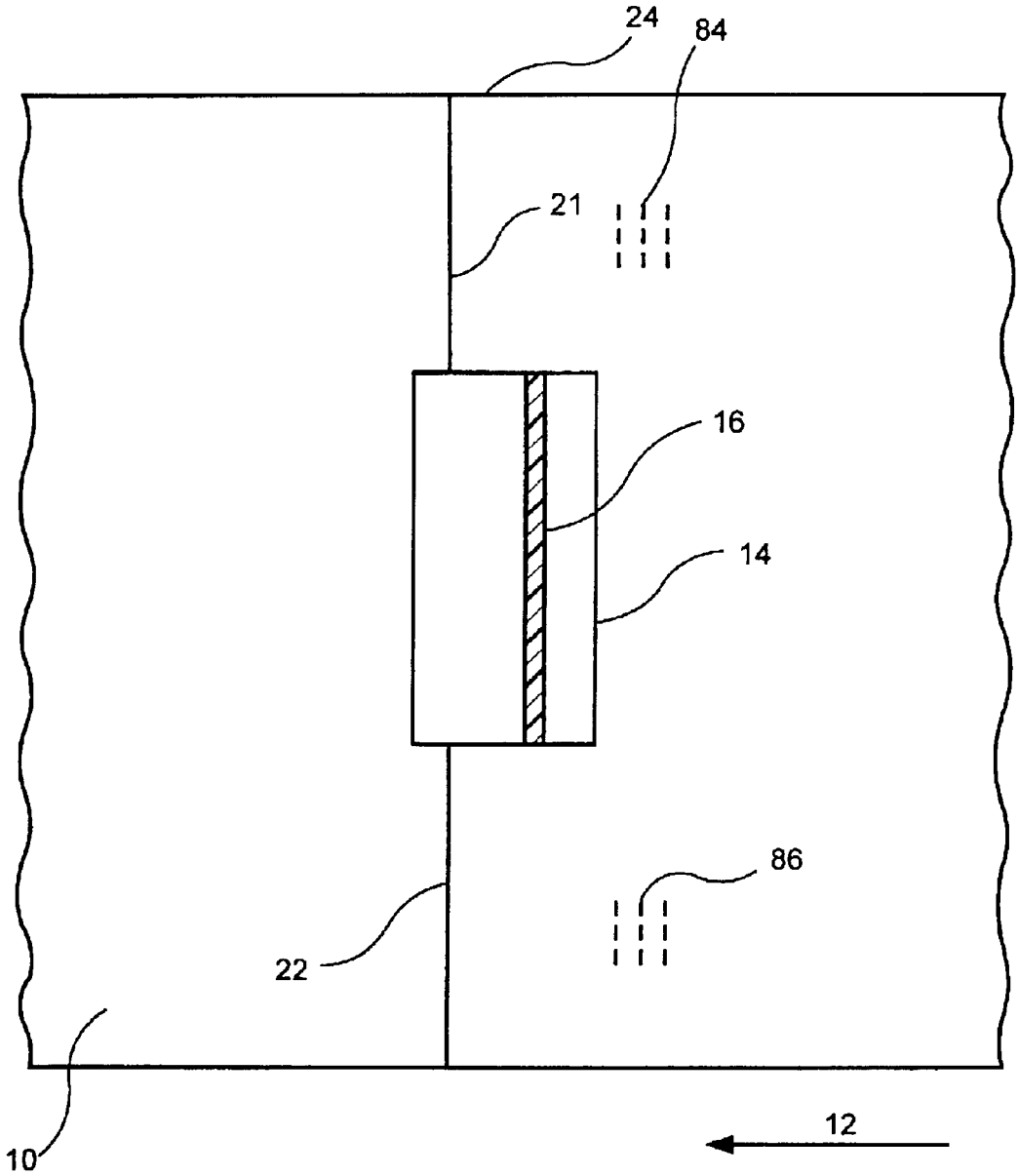
FIG. 26 is a plan view depicting a sixth embodiment of the present invention wherein a fastener with adjacent multi-line perforated areas of weakness is formed on a section of thermoplastic film.

A sixth embodiment of the present invention is shown in FIG. 26. In the figure, a line of weakness 84 is created on side 21 of the film 10 with the line of weakness less than half the length of the line of weakness 80. Additionally, a line of weakness 86 with a length less than half the length of the line of weakness 81 is created on side 22 of the film 10. Similar to the lines of weakness 80, 81 in FIG. 20, the lines of weakness 84, 86 in FIG. 26 align to an area to the right of and parallel with the fastener strip 14.

Figure 27:
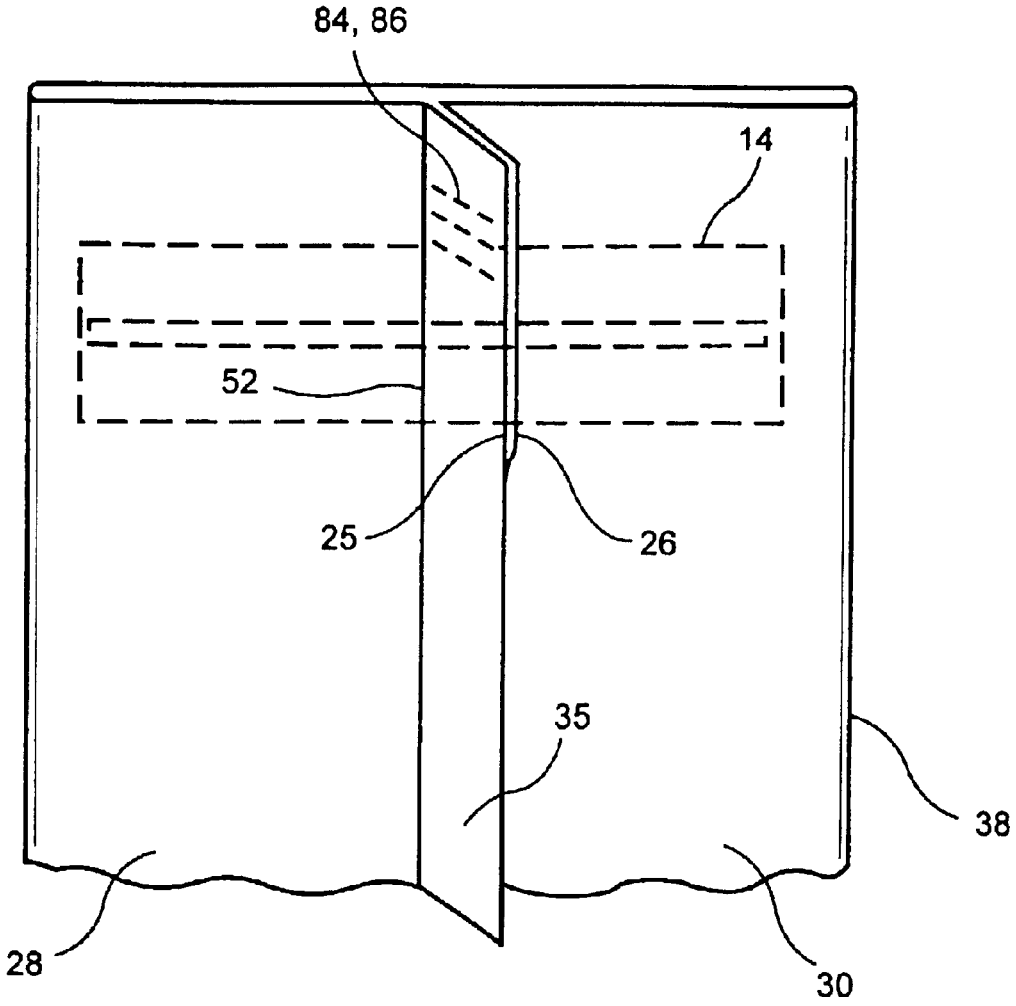
FIG. 27 is a side view depicting the sixth embodiment of the present invention wherein a fin seal has been formed at a cross-jaw section of a form-fill and seal machine.

Using the bag forming process described for FIGS. 2A and 3A, a bag with the fin seal 35 is shown in FIG. 27. When the wall sections are folded to form the fin seal 35, lines of weakness 84, 86 should be fully on the fin seal with the lines of weakness ending short of the fold line 52 and preferably in alignment with each other. This allows the resultant reclosable bag to be hermetically sealed since the lines of weakness 84, 86 are not on any bag wall.

Figure 28:
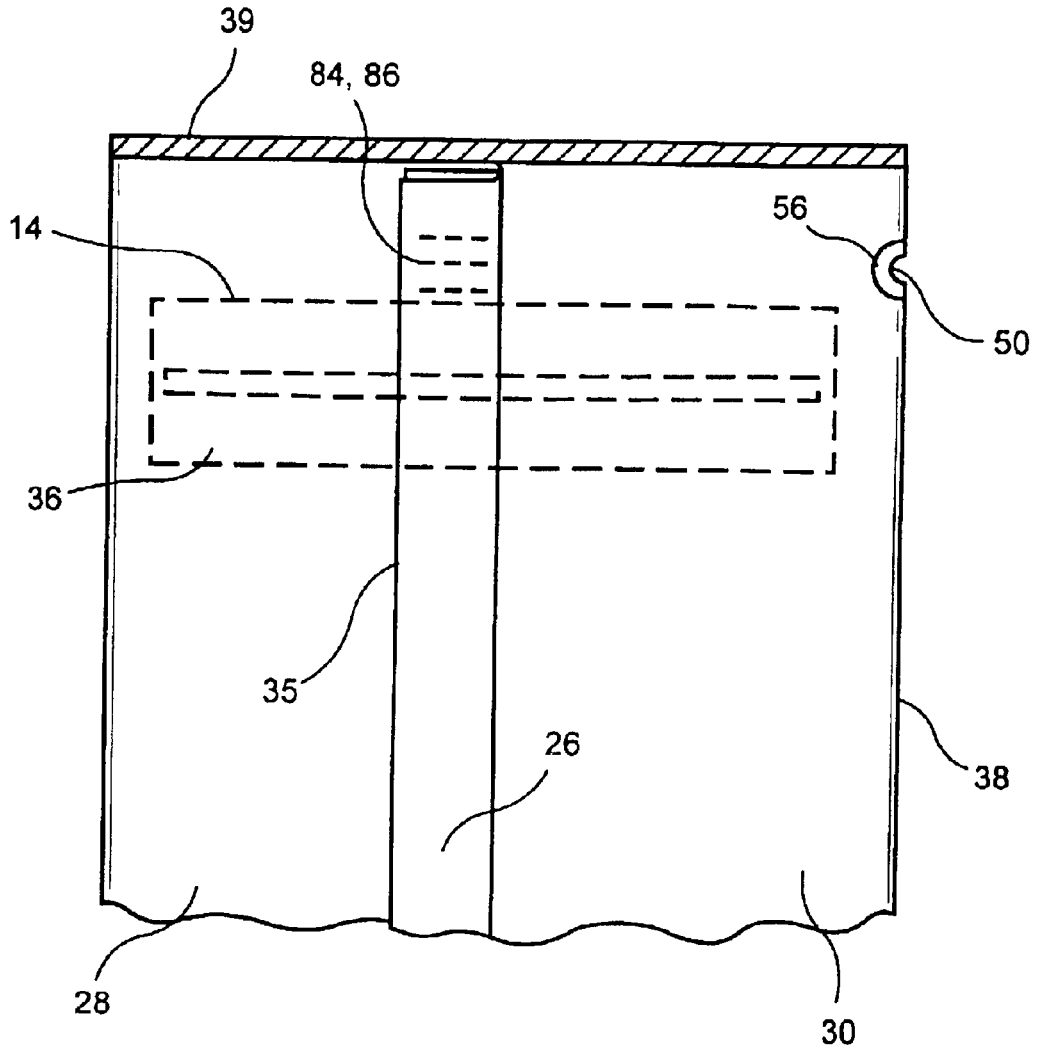
FIG. 28 is a side view depicting the sixth embodiment of the present invention wherein a reclosable bag has been formed with a tear notch on the edge of the reclosable bag.

In FIG. 28, the thermoplastic film for forming the bag is folded into a tube by the form-fill and seal machine. The wall sections 28 and 30 are sealed to the upper flange 36. The bottom cross-seal and the top cross-seal 39 are formed, thereby creating the reclosable bag 38. Alternatively, the line of weakness 86 can be applied on the side margin 26 after the fin seal is formed instead of at the stage of manufacturing described earlier.

Figure 29:
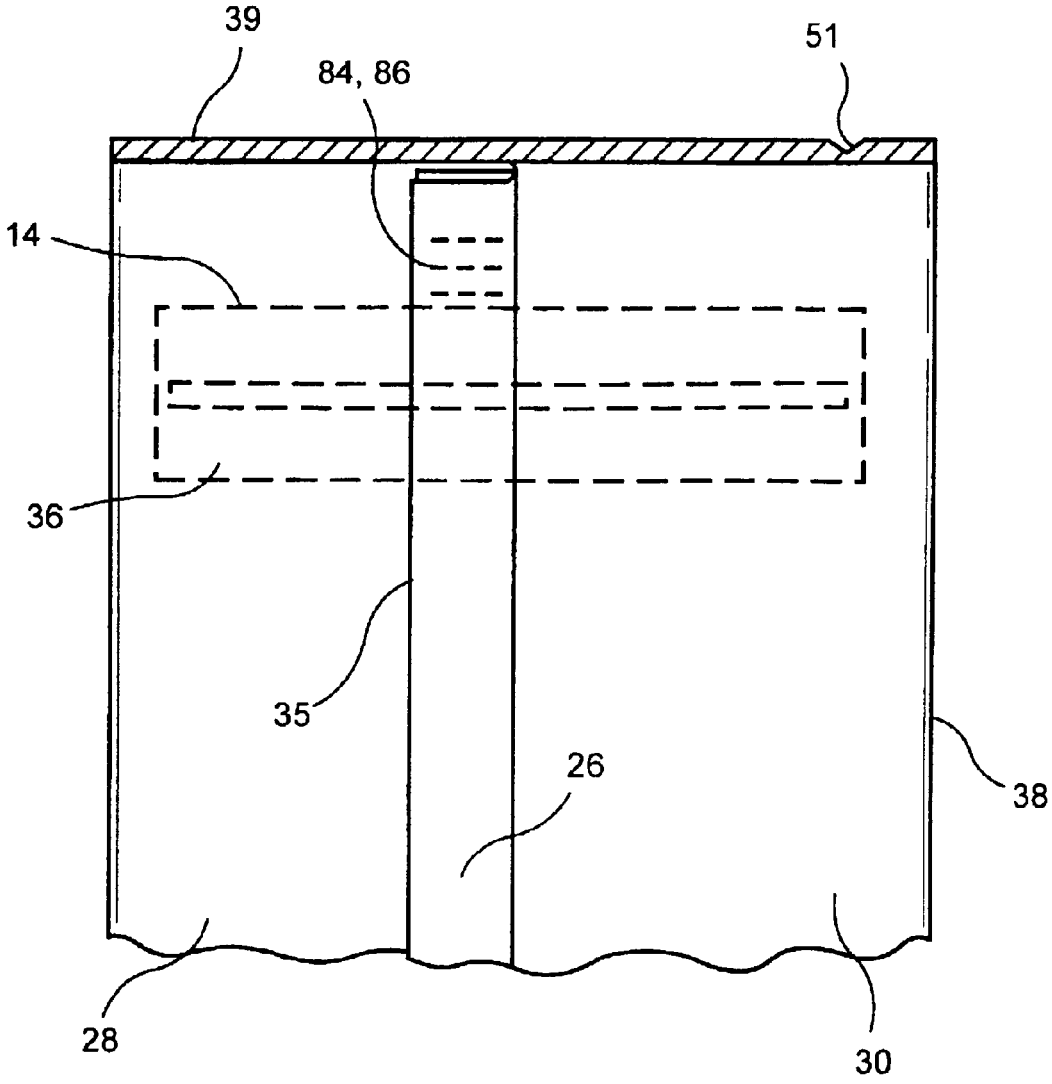
FIG. 29 is a side view depicting the sixth embodiment of the present invention wherein a reclosable bag has been formed with a tear notch formed in the cross-seal of the reclosable bag.

To assist in reaching the perforations, the tear notch 50 is formed by cutting or melting away material from an edge of the reclosable bag 38. If a hermetic seal is necessary for the notch 50, a melting operation is used to form the notch. The peripheral melt zone 56 would join the front and rear walls of the package around the notch and hence would seal the contents of the interior of the reclosable bag from exposure via the notch. As shown in FIG. 29, the alternative tear notch 51 may be formed by cutting or melting away material from the top cross-seal 39.

Figure 30:
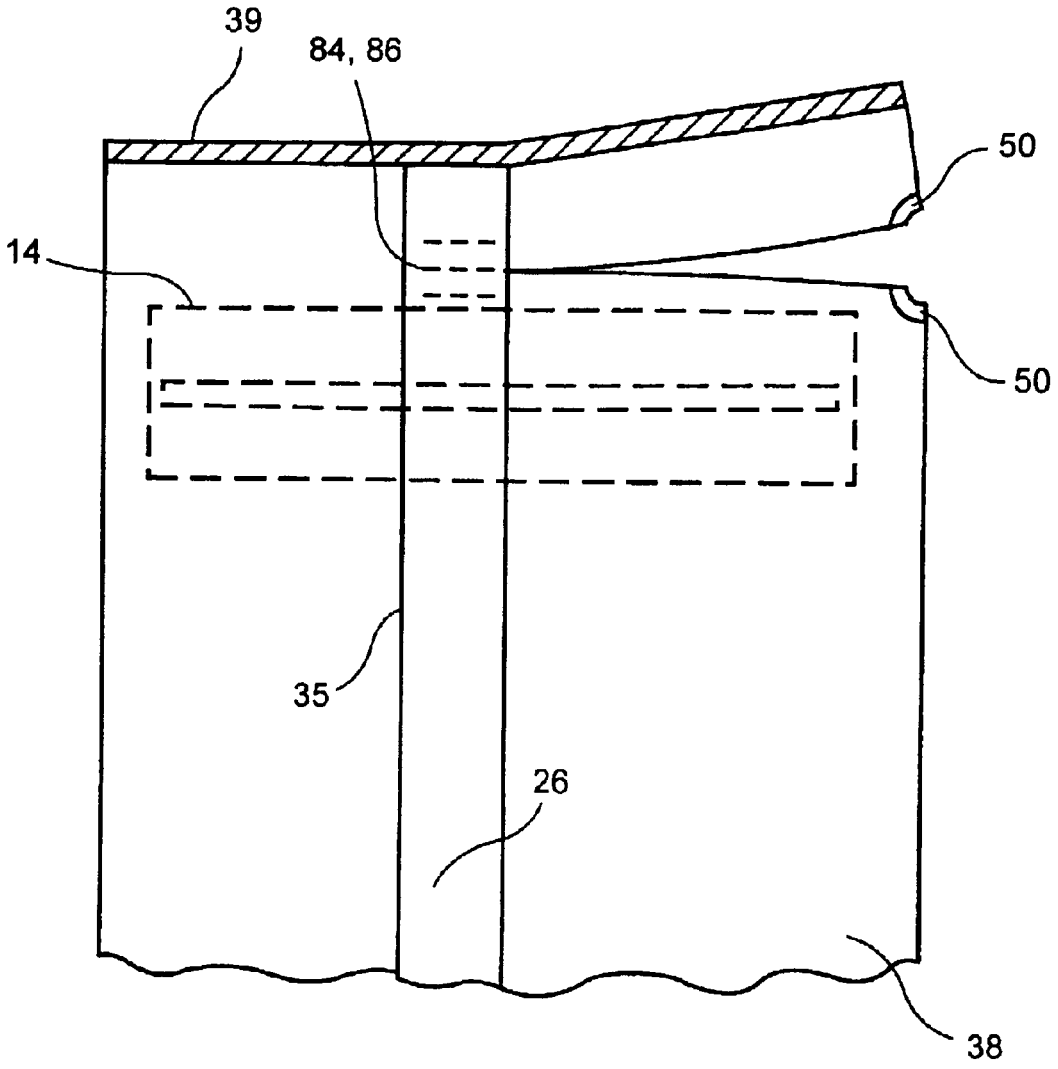
FIG. 30 is a side view depicting the sixth embodiment of the present invention with the reclosable bag shown in an opening condition.

FIG. 30 depicts the reclosable bag 38 in an opening condition. The notch 50 is separated by a tearing force produced by the user, allowing the tearing force to continue to the fin seal 35 of the bag along the top of fastener strip 14. As the tearing force proceeds, the hindrance of the fin seal 35 is reduced by the lines of weakness 84, 86 since the tearing force encounters a weakened layer of the fin seal 35. The fastener 14 prevents the tear pattern from continuing down the length of the reclosable bag 38 and prevents the package from being destroyed. Once the tearing is complete, the flanges of the fastener strip 14 can be gripped by the user to open to the interior of the reclosable bag 38.

Figure 31:
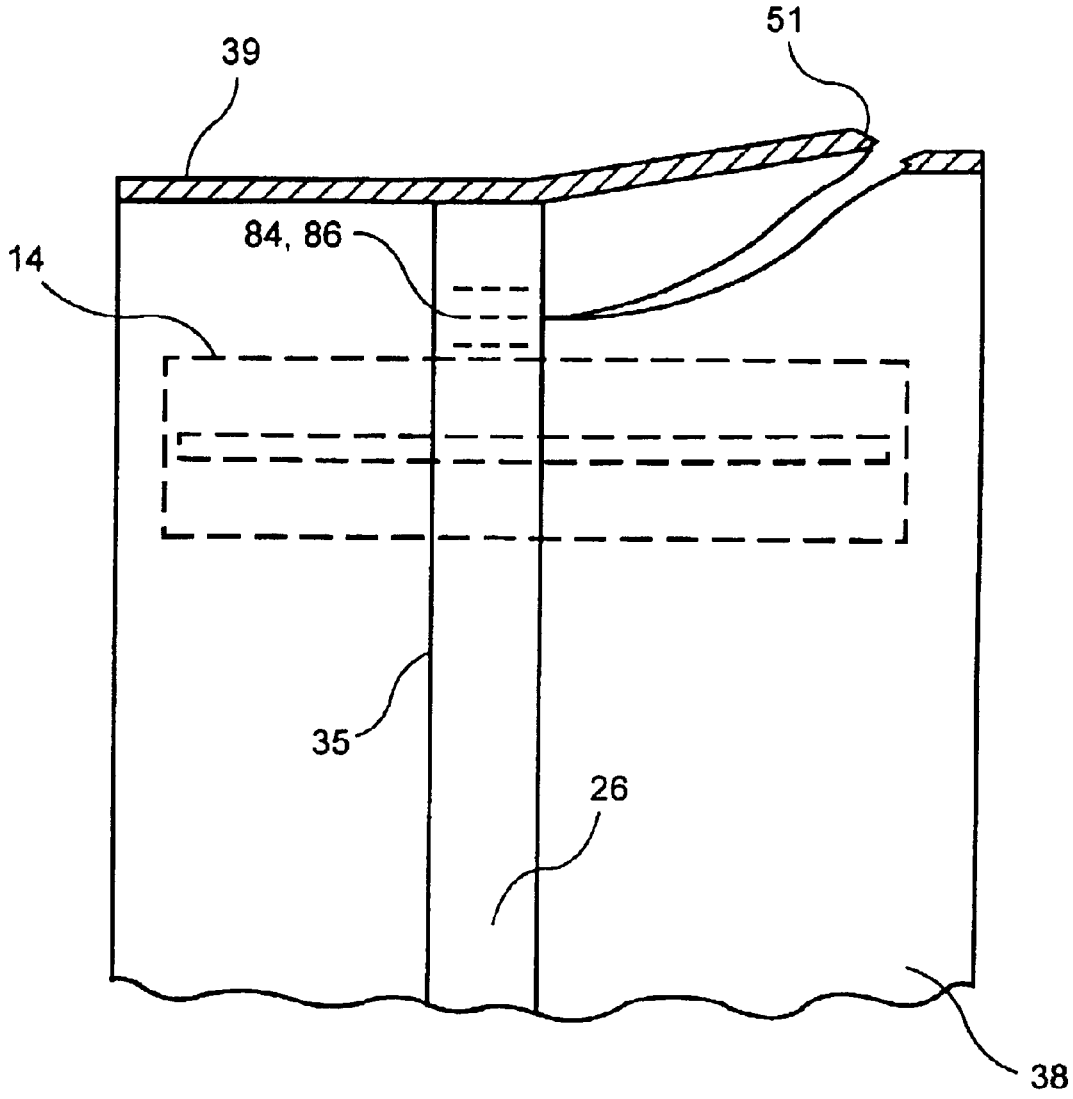
FIG. 31 is a side view depicting the sixth embodiment of the present invention with the reclosable bag shown in an alternative opening condition.

FIG. 31 depicts the reclosable bag 38 in an alternative opening condition using the tear notch 51. The notch 51 is separated by a tearing force produced by the user, thereby allowing the tearing force to continue along the top of the fastener 14 to the lines of weakness 84, 86. As the tearing force proceeds, the hindrance of the fin seal 35 is reduced since the tearing force encounters a weakened layer of the fin seal. The fastener 14 prevents the tear pattern from continuing down the length of the reclosable bag 38 and prevents the package from being destroyed. Once the tearing is complete, the flanges of the fastener strip 14 can be gripped by the user to open to the interior of the reclosable bag 38.

Figure 32:
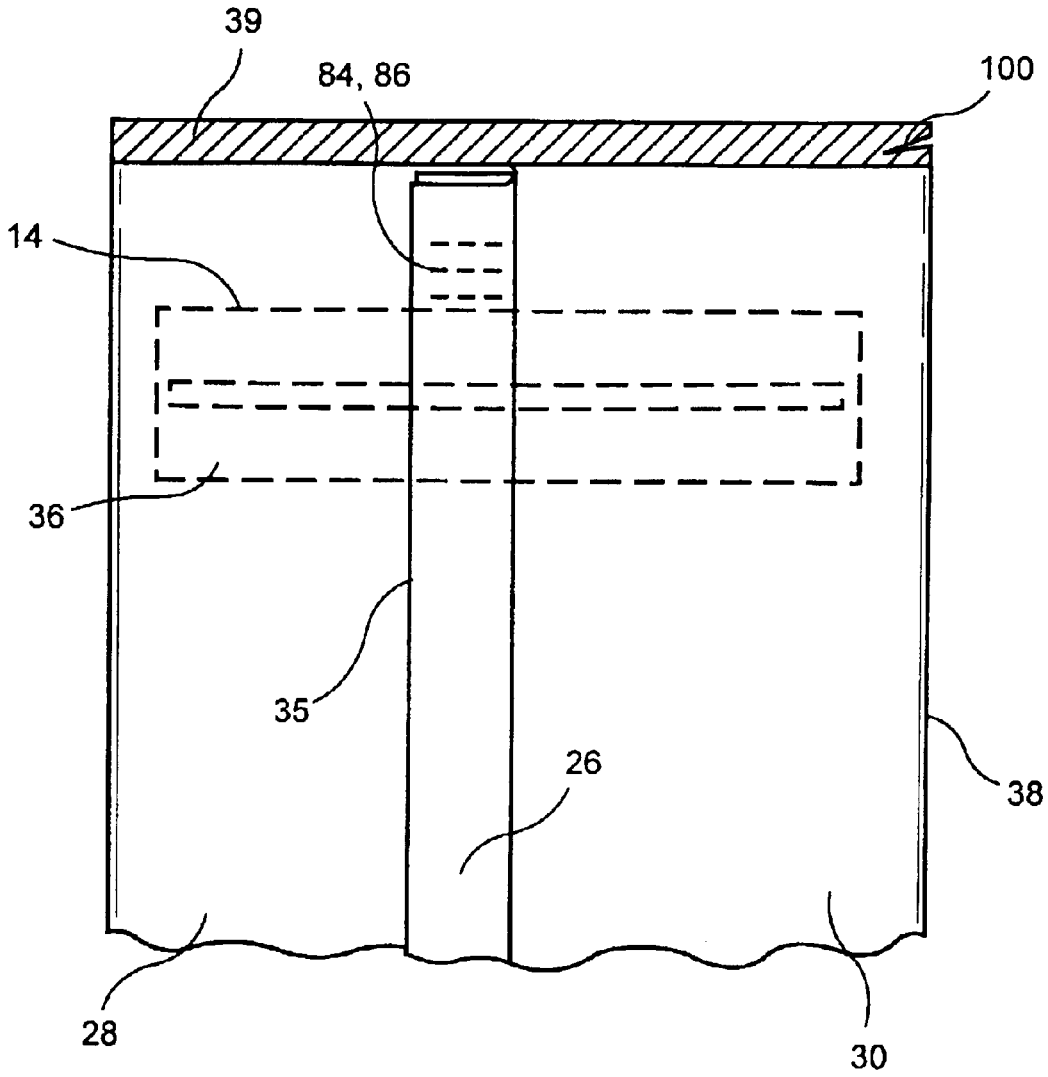
FIG. 32 is a side view depicting the sixth embodiment of the present invention wherein a reclosable bag has been formed with a tear notch formed in an alternative position in the cross-seal of the reclosable bag.
Figure 33:
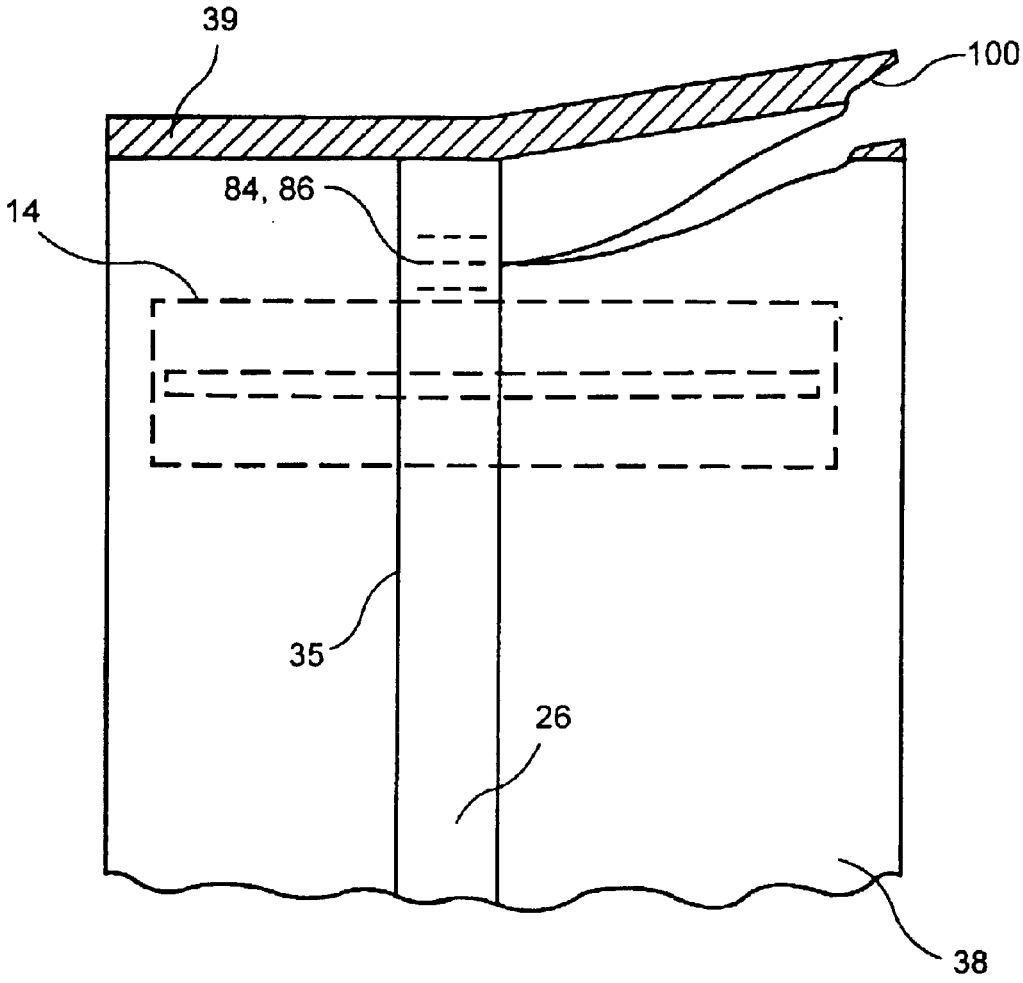
FIG. 33 is a side view of the sixth embodiment of the present invention with the reclosable bag shown in an alternative opening condition.

FIG. 32 depicts another alternative tear notch 100 formed in the top cross-seal 39 by cutting or melting away material in the cross-seal. FIG. 33 depicts the reclosable bag 38 in another alternative opening condition using the tear notch 100. The notch 51 is separated by a tearing force produced by the user, thereby allowing the tearing force to continue along the top of the fastener 14 to the lines of weakness 84, 86. As the tearing force proceeds, the hindrance of the fin seal 35 is reduced since the tearing force encounters a weakened layer of the fin seal. The fastener 14 prevents the tear pattern from continuing down the length of the reclosable bag 38 and prevents the package from being destroyed. Once the tearing is complete, the flanges of the fastener strip 14 can be gripped by the user to open to the interior of the reclosable bag 38.

Although the tear notch 100 is shown for the sixth embodiment of the present invention, the tear notch may be formed in the cross-seal 39 for the fourth and fifth embodiments of the present invention. The separation of the notch 100, as described for FIG. 33, would be similar for the areas of weakness described for the fourth and fifth embodiments.

Thus, the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method for producing a reclosable plastic bag comprising the steps of:

advancing a length of bag making film in a bag forming direction;

attaching a length of fastener having first and second mateable profile strips to a mid-portion of said bag making film transverse to said bag forming direction, leaving sides of film on opposite ends of said length of fastener;

creating an area of weakness in at least one of said sides extending into a side margin of said at least one side, wherein said area of weakness comprises an aperture;

after creating said area of weakness, sealing said side margin of said at least one side, including a portion of said aperture, together with a side margin of said opposite side in a fin seal to form a tube and thereby partially disposing said area of weakness on said fin seal;

sealing said length of fastener to an inner surface of said tube; and cross-sealing across said tube at spaced intervals on opposite sides of said fastener to form a bag with a top seal and a bottom seal.

2. The method in accordance with claim 1 wherein one flange of said first profile strip includes a first longitudinally extending line of weakness, the method comprising the further step of aligning said area of weakness with said first line of weakness.

3. The method in accordance with claim 2 wherein one flange of the second profile strip includes a second longitudinally extending line of weakness substantially aligned with the first line of weakness of said first profile.

4. The method in accordance with claim 3 wherein a portion of said opposite side margin seals to said flange of said second profile through said aperture.

5. The method in accordance with claim 4 comprising the further steps of:

forming a notch in a side edge of said bag aligned with said aperture; and sealing surfaces of said bag surrounding the notch together, thereby sealing said notch from the bag interior.

6. The method in accordance with claim 3 comprising the further steps of:

forming a notch in a side edge of said bag aligned with said third line of weakness; and sealing surfaces of said bag surrounding the notch together, thereby sealing said notch from the bag interior.

7. The method in accordance with claim 1 wherein a portion of said opposite side margin seals to said bag making film through said aperture.

8. The method in accordance with claim 7 comprising the further steps of:

forming a notch in a side edge of said bag aligned with said aperture; and sealing surfaces of said bag surrounding the notch together, thereby sealing said notch from the bag interior.

9. The method in accordance with claim 1 comprising the further steps of:

forming a notch in a side edge of said bag aligned with said line of weakness; and sealing surfaces of said bag surrounding the notch together, thereby sealing said notch from the bag interior.

10. A method for producing a reclosable plastic bag comprising the steps of:

advancing a length of bag making film in a bag forming direction;

attaching a length of fastener having first and second mateable profile strips to a mid-portion of said bag making film transverse to said bag forming direction, leaving sides of film on opposite ends of said length of fastener;

sealing a side margin of one side of said film together with a side margin of an opposite side in a fin seal to form a tube;

creating an area of weakness on said fin seal, wherein said area of weakness comprises a aperture in said side margin of one side of said film, wherein said side margin of said opposite side is free of any aperture;

sealing said length of fastener to an inner surface of said tube; and cross-sealing across said tube at spaced intervals on opposite sides of said fastener to form a bag with a top seal and a bottom seal.

11. The method in accordance with claim 10 wherein one flange of said first profile strip includes a first longitudinally extending line of weakness and one flange of said second profile strip includes a second longitudinally extending line of weakness, the method comprising the further step of aligning said area of weakness with said first and second lines of weakness.

* * * * *